US011062687B2

(12) United States Patent
Honda

(10) Patent No.: US 11,062,687 B2
(45) Date of Patent: Jul. 13, 2021

(54) COMPENSATION FOR MICROPHONE ROLL-OFF VARIATION IN ACOUSTIC DEVICES

(71) Applicant: Bose Corporation, Framingham, MA (US)

(72) Inventor: Masanori Honda, Northborough, MA (US)

(73) Assignee: Bose Corporation, Framingham, MA (US)

( * ) Notice: Subject to any disclaimer, the term of this patent is extended or adjusted under 35 U.S.C. 154(b) by 44 days.

(21) Appl. No.: 16/240,135

(22) Filed: Jan. 4, 2019

(65) Prior Publication Data

US 2020/0219477 A1 Jul. 9, 2020

(51) Int. Cl.

| | |
|---|---|
| ***G10K 11/178*** | (2006.01) |
| ***H04R 29/00*** | (2006.01) |
| ***H04R 3/06*** | (2006.01) |
| ***H04R 3/04*** | (2006.01) |

(52) U.S. Cl.

CPC .. *G10K 11/17853* (2018.01); *G10K 11/17881* (2018.01); *G10K 2210/1081* (2013.01); *G10K 2210/3028* (2013.01); *G10K 2210/3212* (2013.01); *H04R 3/04* (2013.01); *H04R 3/06* (2013.01); *H04R 29/004* (2013.01)

(58) Field of Classification Search

CPC ..... G10K 11/17853; G10K 11/17881; G10K 2210/1081; G10K 2210/3028; G10K 2210/3212; H04R 3/00; H04R 3/04; H04R 3/06; H04R 3/08; H04R 29/00; H04R 29/004; H04R 29/005; H04R 29/006; H04R 2201/003

USPC ..... 381/71.6, 71.12, 71.13, 71.14, 71.11, 381/73.1, 57, 74, 98, 91, 92, 122, 95, 381/111–115

See application file for complete search history.

(56) References Cited

U.S. PATENT DOCUMENTS 5,495,501 A * 2/1996 Iwamatsu ..... H04L 25/03044 375/229
8,073,150 B2 12/2011 Joho et al.
8,073,151 B2 12/2011 Joho et al.
(Continued)

FOREIGN PATENT DOCUMENTS

WO WO 2013/108081 7/2013
WO WO 2017/157847 9/2017

OTHER PUBLICATIONS

U.S. Appl. No. 15/710,354, terMeulen et al., filed Sep. 20, 2017.
(Continued)

*Primary Examiner* — Xu Mei
(74) *Attorney, Agent, or Firm* — Fish & Richardson P.C.

(57) ABSTRACT

An active noise reduction (ANR) device includes a first sensor configured to generate an input signal indicative of an environment of the active noise reduction device, in which the first sensor has a measured roll-off frequency. A first compensator processes the input signal to generate a compensated input signal to compensate a difference between the measured roll-off frequency and a predetermined roll-off frequency for the first sensor. A second compensator processes the compensated input signal to generate a first signal for an acoustic transducer of the active noise reduction headphone.

35 Claims, 16 Drawing Sheets

(56) References Cited

U.S. PATENT DOCUMENTS

| | | | | |
|---|---|---|---|---|
| 8,682,002 | B2 * | 3/2014 | Wihardja | H03G 5/005 381/72 |
| 9,082,388 | B2 | 7/2015 | Annunziato et al. | |
| 2003/0198356 | A1 * | 10/2003 | Thompson | H04R 25/407 381/92 |
| 2004/0076302 | A1 * | 4/2004 | Christoph | H03G 3/32 381/57 |
| 2010/0310084 | A1 * | 12/2010 | Hersbach | H04R 25/453 381/71.6 |
| 2014/0072135 | A1 * | 3/2014 | Bajic | G10K 11/17853 381/71.11 |
| 2014/0341387 | A1 * | 11/2014 | Gauger, Jr. | H04R 3/002 381/71.6 |
| 2015/0030166 | A1 * | 1/2015 | Ranieri | H04R 29/005 381/58 |
| 2018/0286373 | A1 * | 10/2018 | O'Connell | H04R 3/005 |
| 2018/0286374 | A1 | 10/2018 | Cattell et al. | |

OTHER PUBLICATIONS

U.S. Appl. No. 16/124,056, Rule et al., filed Sep. 6, 2018.
International Search Report and Written Opinion in International Appln. No. PCT/US2019/068403, dated Mar. 30, 2020, 9 pages.

* cited by examiner

COMPENSATION FOR MICROPHONE ROLL-OFF VARIATION IN ACOUSTIC DEVICES

TECHNICAL FIELD

The description generally relates to compensation for microphone roll-off variations in acoustic devices, and more particularly to compensation for microphone roll-off variations to improve active noise reduction in acoustic devices.

BACKGROUND

Acoustic devices such as headphones can include active noise reduction (ANR) capabilities that block at least portions of ambient noise from reaching the ear of a user. The acoustic device may include one or more microphones, one or more output transducers, and a noise reduction circuit coupled to the one or more microphones and output transducers to provide anti-noise signals to the one or more output transducers based on the signals detected at the one or more microphones. The anti-noise signals cancel at least portions of the ambient noise to reduce the amount of ambient noise reaching the ear of the user.

SUMMARY

This document describes acoustic devices that include microphones and compensation modules for compensating the variations in the measured frequency response characteristics of the microphones from their specified or nominal frequency response characteristics, including compensating for variations in the low frequency roll-offs.

In a general aspect, an active noise reduction device includes a first sensor configured to generate an input signal indicative of an external environment of the active noise reduction device, in which the first sensor has a measured roll-off frequency; a first compensator configured to process the input signal to generate a compensated input signal, in which the first compensator is configure to compensate a difference between the measured roll-off frequency and a predetermined roll-off frequency for the first sensor; and a second compensator to process the compensated input signal to generate a first signal for an acoustic transducer of the active noise reduction headphone.

Implementations of the active noise reduction device can include one or more of the following features. The first sensor can include a micro-electro-mechanical system (MEMS) microphone. The first sensor can be designed to have the predetermined roll-off frequency equal to f1 KHz, and the first sensor is manufactured using a process that, due to manufacturing tolerances, produces sensors that have measured roll-off frequencies that range from 0.8×f1 KHz to 1.2×f1 KHz, and the first compensator compensates for the difference between the measured roll-off frequency and f1 KHz. The first compensator can include a bi-quad filter. The bi-quad filter can include a digital bi-quad filter having at least one adjustable coefficient that is configured to be adjusted based on the measured roll-off frequency of the first sensor. The at least one adjustable coefficient of the digital bi-quad filter can be configured to be adjusted such that a combination of the first sensor and the first compensator has a frequency response that more closely resembles the frequency response of a sensor having the predetermined roll-off frequency, as compared to the frequency response of the first sensor. The digital bi-quad filter can have a transfer function represented by $$H(z) = \frac{b_0 + b_1 z^{-1} + b_2 z^{-2}}{1 + a_1 z^{-1} + a_2 z^{-2}},$$

and the coefficient b1 can be configured to be adjusted based on the measured roll-off frequency of the first sensor. The first sensor can have a first frequency response, the first compensator can have a second frequency response that approximates a ratio between a predetermined frequency response and the first frequency response, and the predetermined frequency response can have the predetermined roll-off frequency. The first sensor can have a first frequency response that corresponds to a first transfer function, a second frequency response can have the predetermined roll-off frequency correspond to a second transfer function, and the first compensator can have a third transfer function that is a ratio between the second transfer function and the first transfer function. The second compensator can be optimized to operate with a sensor having the predetermined roll-off frequency, and the first compensator can modify the input signal such that the compensated input signal mimics an input signal generated by a sensor having the predetermined roll-off frequency. The first sensor can include a feedforward microphone, and the second compensator can include a feedforward compensator disposed in a feedforward signal flow path of the active noise reduction headphone. The first signal cam represent an anti-noise signal configured to reduce an effect of ambient noise on an output of the acoustic transducer. The active noise reduction device can further include a feedback microphone and a feedback compensator disposed in a feedback signal flow path of the active noise reduction headphone, in which the feedback compensator is configured to generate a second signal for the acoustic transducer. The first sensor can include a feedback microphone, the second compensator can include a feedback compensator disposed in a feedback signal flow path of the active noise reduction headphone, and the feedback compensator can be configured to generate a second signal for the acoustic transducer.

In another general aspect, an apparatus includes a microphone configured to generate a pickup signal indicative of an external environment of the apparatus, in which the microphone has a measured roll-off frequency that is different from a specified or nominal roll-off frequency for the microphone; and a compensator configured to process the pickup signal to generate a compensated pickup signal, in which the compensator is configure to compensate a difference between the measured roll-off frequency and the specified or nominal roll-off frequency for the microphone. The microphone can include a micro-electro-mechanical system (MEMS) microphone. The microphone can be designed to have the specified or nominal roll-off frequency equal to f1 KHz, and the microphone is manufactured using a process that, due to manufacturing tolerances, produces microphones that have measured roll-off frequencies that range from 0.8×f1 KHz to 1.2×f1 KHz, and the compensator compensates for the difference between the measured roll-off frequency and f1 KHz. The compensator can include a bi-quad filter. The bi-quad filter can include a digital bi-quad filter having at least one adjustable coefficient that is configured to be set based on the measured roll-off frequency of the microphone. The at least one adjustable coefficient of the digital bi-quad filter can be configured to be set such that a combination of the microphone and the compensator has a first roll-off frequency that is more similar to the specified roll-off frequency as compared to the measured roll-off frequency. The digital bi-quad filter can have a transfer function represented by $$H(z) = \frac{b_0 + b_1 z^{-1} + b_2 z^{-2}}{1 + a_1 z^{-1} + a_2 z^{-2}},$$

and the coefficient b1 is configured to be set based on the measured roll-off frequency of the microphone. The microphone can have a first frequency response, the compensator can have a second frequency response that approximates a ratio between a predetermined frequency response and the first frequency response, and the predetermined frequency response has the specified roll-off frequency. The microphone can have a first frequency response that corresponds to a first transfer function, a second frequency response having the predetermined roll-off frequency can correspond to a second transfer function, and the compensator can have a third transfer function that is a ratio between the second transfer function and the first transfer function. The apparatus can comprises a circuit that is optimized to operate with a microphone having the specified roll-off frequency, and the compensator can modify the pickup signal such that the compensated pickup signal mimics a pickup signal generated by a microphone having the specified roll-off frequency.

In another general aspect, a method includes receiving an input signal representing audio captured by a microphone of an active noise reduction headphone; processing, by a first compensator, the input signal to generate a compensated input signal, in which processing the input signal comprises compensating a difference between the measured roll-off frequency and a predetermined roll-off frequency for the microphone; and processing, by a second compensator, the compensated input signal to generate a first signal for an acoustic transducer of the active noise reduction headphone.

Implementations of the method can include one or more of the following features. The first compensator can include a digital bi-quad filter having at least one adjustable coefficient that is set based on the measured roll-off frequency of the first sensor. The at least one adjustable coefficient can be set to a value such that a combination of the first sensor and the first compensator has a frequency response that more closely resembles the frequency response of a microphone having the specified roll-off frequency, as compared to the frequency response of the first sensor. The digital bi-quad filter can have a transfer function represented by $$H(z) = \frac{b_0 + b_1 z^{-1} + b_2 z^{-2}}{1 + a_1 z^{-1} + a_2 z^{-2}},$$

and the coefficient b1 can be set based on the measured roll-off frequency of the first sensor. The second compensator can be optimized for the predetermined roll-off frequency, and processing the input signal can include modifying the input signal such that the compensated input signal mimics an input signal generated by a microphone having the predetermined roll-off frequency. Generating the first signal can include generating an anti-noise signal to reduce an effect of ambient noise on an output of the acoustic transducer. In some examples, receiving the input signal can include receiving an input signal representing audio captured by a feedforward microphone of the active noise reduction headphone. The second compensator can include a feedforward compensator disposed in a feedforward signal flow path of the active noise reduction headphone. In some examples, receiving the input signal can include receiving an input signal representing audio captured by a feedback microphone of the active noise reduction headphone. The second compensator can include a feedback compensator disposed in a feedback signal flow path of the active noise reduction headphone.

In another general aspect, a method of calibrating an active noise reduction headphone having a microphone is provided. The method includes measuring a roll-off frequency of the microphone to determine a measured roll-off frequency; and adjusting a configuration of a first compensator of the active noise reduction headphone, in which the first compensator is configured to compensate for a difference between the measured roll-off frequency and a predetermined roll-off frequency for the microphone, wherein the active noise reduction headphone comprises a second compensator that is configured to process an output of the first compensator to generate a first signal for an acoustic transducer of the active noise reduction headphone.

Implementations of the method can include one or more of the following features. The first compensator can include a digital bi-quad filter having at least one adjustable coefficient, and adjusting the configuration of the first compensator can include adjusting the at least one adjustable coefficient of the digital bi-quad filter based on the measured roll-off frequency of the first sensor.

In another general aspect, a method includes receiving an input signal representing audio captured by a microphone having a measured roll-off frequency; and processing, by a compensator, the input signal to generate a compensated input signal, in which processing the input signal comprises compensating a difference between the measured roll-off frequency and a specified roll-off frequency for the microphone.

Implementations of the method can include one or more of the following features. The compensator can include a digital bi-quad filter having at least one adjustable coefficient that is set based on the measured roll-off frequency of the microphone. The digital bi-quad filter can have a transfer function represented by $$H(z) = \frac{b_0 + b_1 z^{-1} + b_2 z^{-2}}{1 + a_1 z^{-1} + a_2 z^{-2}},$$

and the coefficient b1 can be set based on the measured roll-off frequency of the microphone.

In another general aspect, one or more machine-readable storage devices having encoded thereon computer readable instructions for causing one or more processing devices to perform operations includes: receiving an input signal representing audio captured by a microphone of an active noise reduction headphone, in which the microphone has a measured roll-off frequency; causing a first compensator to process the input signal to generate a compensated input signal, in which processing the input signal comprises compensating a difference between the measured roll-off frequency and a predetermined roll-off frequency for the microphone; and causing a second compensator to process the compensated input signal to generate a first signal for an acoustic transducer of the active noise reduction headphone.

The aspects described above can be embodied as systems, methods, computer programs stored on one or more computer storage devices, each configured to perform the actions of the methods, or means for implementing the methods. A system of one or more computing devices can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions. Two or more of the features described in this disclosure, including those described in this summary section, may be combined to form implementations not specifically described herein.

Unless otherwise defined, all technical and scientific terms used herein have the same meaning as commonly understood by one of ordinary skill in the art to which this invention belongs. In case of conflict with patents or patent applications incorporated herein by reference, the present specification, including definitions, will control.

Other features and advantages of the description will become apparent from the following description, and from the claims.

DETAILED DESCRIPTION

Figure 1:
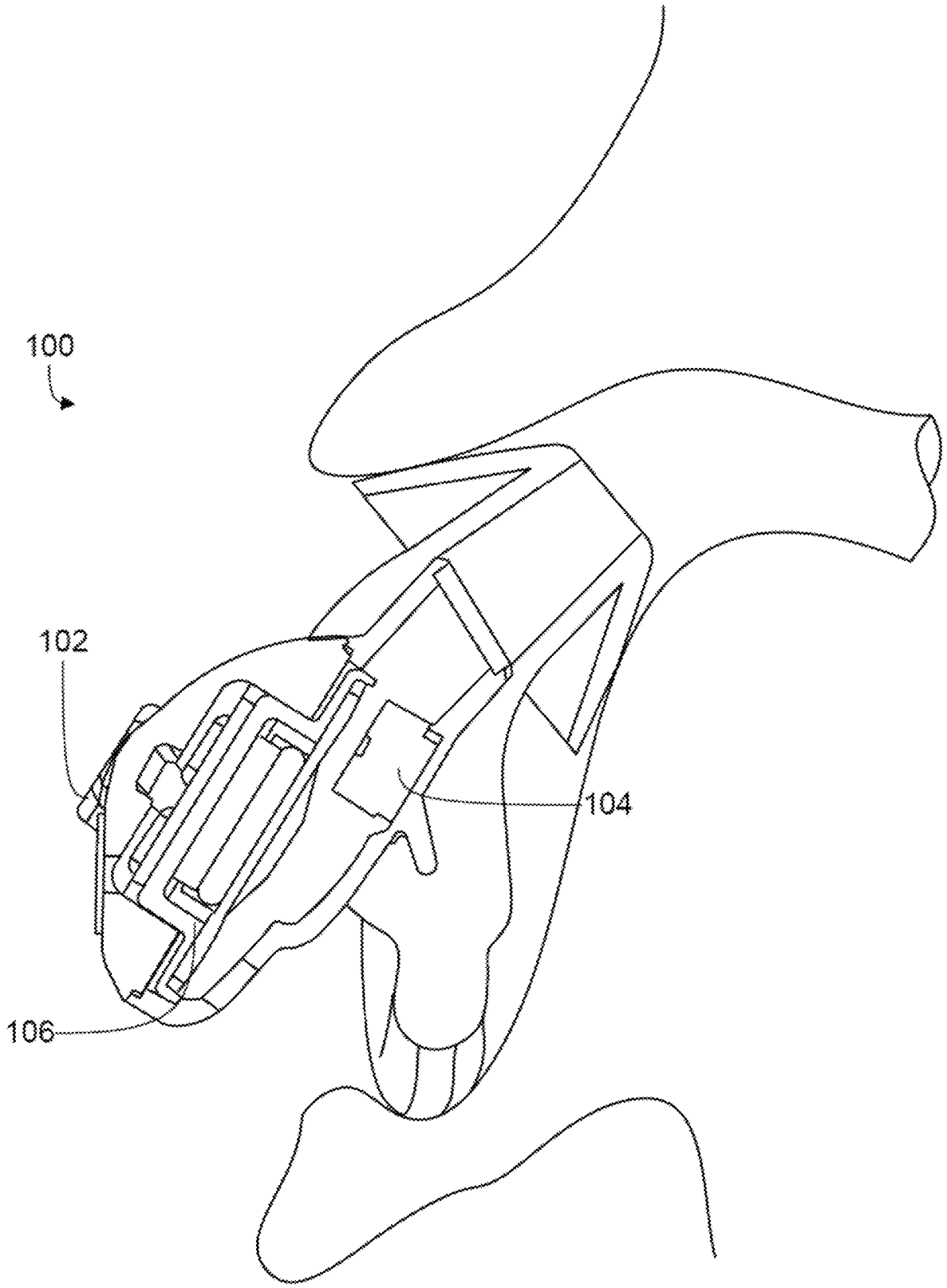
FIG. 1 shows an example of an in-the-ear active noise reduction headphone.

In this document we describe technology that improves the performance of active noise reduction (ANR) in acoustic devices by compensating for variations in roll-off frequencies of microphones used in the acoustic devices. Active noise reduction devices such as active noise reduction headphones are used for providing potentially immersive listening experiences by reducing effects of ambient noise and sounds. In some implementations, the active noise reduction device may include a feedforward microphone, a feedback microphone, an output transducer, and a noise reduction circuit coupled to the microphones and output transducer to provide anti-noise signals to the output transducer based on the signals detected at the microphones. The active noise reduction device may include a first compensation module to compensate for the variation in the low frequency roll-off of the feedforward microphone from a specified or nominal value in order to improve the performance of the noise reduction circuit. The active noise reduction device may include a second compensation module to compensate for the variation in the low frequency roll-off of the feedback microphone from a specified or nominal value in order to improve the performance of the noise reduction circuit.

For example, the noise reduction circuit may be designed to operate optimally with a feedforward (or feedback) microphone having a specific low frequency roll-off, e.g., at frequency f1. If the feedforward (or feedback) microphone has a measured low frequency roll-off at frequency f2 that is different from f1, the active noise reduction device may not provide the optimal noise cancellation. The compensation module is designed such that the combination of the compensation module and the feedforward (or feedback) microphone produces a frequency response having a low frequency roll-off at a frequency equal to or approximately equal to f1. This allows the noise reduction circuit to operate in a more optimal manner (as compared to not using the compensation module), thus enabling the active noise reduction device to provide better noise cancellation.

The compensation module can be used in many types of active noise reduction devices. For example, and active noise reduction device may or may not include a hear-through mode, in which the noise reduction is turned down for a period of time and the ambient sounds are allowed to be passed to the user's ears. The active noise reduction device can be, e.g., a headphone, a headset, an earphone, an open-ear acoustic device (e.g., a device that includes an electro-acoustic transducer to radiate acoustic energy towards a wearer's ear canal while leaving the ear open to its environment and surroundings), eyeglasses, or a hearing aid. The following describes the compensation module being used in particular types of active noise reduction devices. It should be understood that the compensation module is not limited to being used with the particular types of active noise reduction devices described below, but can also be used with other types of active noise reduction devices.

The compensation module can be used with an acoustic device that does not provide active noise reduction functions. For example, an audio recording device or an audio processing device may be designed to optimally work with a microphone having particular frequency response characteristics, and the compensation module can be used to compensate for deviations of the actual or measured microphone frequency response characteristics from the specified or nominal frequency response characteristics to enable the audio recording device or audio processing device to operate in an optimal manner.

Referring to FIG. 1, an acoustic implementation of an in-ear active noise reduction headphone 100 includes a feedforward microphone 102, a feedback microphone 104, an output transducer 106 (which may also be referred to as an electroacoustic transducer or acoustic transducer), and a noise reduction circuit (not shown) coupled to both microphones 102, 104 and the output transducer 106 to provide anti-noise signals to the output transducer 106 based on the signals detected at both microphones 102, 104. An additional input (not shown in FIG. 1) to the circuit provides additional audio signals, such as music or communication signals, for playback over the output transducer 106 independently of the noise reduction signals. Additional information regarding the in-ear active noise reduction headphone 100 can be found in, e.g., U.S. Pat. No. 9,082,388, incorporated herein by reference in its entirety.

The noise reduction circuit can include a configurable digital signal processor (DSP) that can implement various signal flow topologies and filter configurations. Examples of such digital signal processors are described in U.S. Pat. Nos. 8,073,150 and 8,073,151, which are incorporated herein by reference in their entirety.

The term headphone, which is interchangeably used herein with the term headset, includes various types of personal acoustic devices such as in-ear, around-ear, over-the-ear, or open-ear headsets, earphones, and hearing aids. The headsets or headphones can include an earbud or ear cup for each ear. The earbuds or ear cups may be physically tethered to each other, for example, by a cord, an over-the-head bridge or headband, or a behind-the-head retaining structure. In some implementations, the earbuds or ear cups of a headphone may be connected to one another via a wireless link.

The active noise reduction headphone 100 offers a feature commonly called "talk-through" or "monitor," in which the feedforward microphone 102 is used to detect external sounds that the user may want to hear. In some implementations, the feedforward microphone 102, upon detecting sounds in the voice-band or some other frequency band of interest, can allow signals in the corresponding frequency bands to be piped through the active noise reduction headphone 100. In some implementations, the active noise reduction headphone 100 allows multi-mode operations, in which in a "hear-through" mode, the active noise reduction functionality may be switched off or at least reduced, over at least a range of frequencies, to allow relatively wide-band ambient sounds to reach the user. In some implementations, the active noise reduction headphone 100 allows the user to control the amount of noise and ambient sounds that pass through the active noise reduction headphone 100.

In some implementations, an active noise reduction signal flow path is provided in parallel with a pass-through signal flow path, in which the gain of the pass-through signal path is controllable by the user. This may allow for implementing active noise reduction devices where the amount of ambient noise passed through can be adjusted based on user-input (e.g., either in discrete steps, or substantially continuously) without having to turn-off or reduce the active noise reduction provided by the device. In some examples, this may improve the overall user experience, for example, by avoiding any audible artifacts associated with switching between active noise reduction and pass-through modes, and/or putting the user in control of the amount of ambient noise that the user wishes to hear. This in turn can make active noise reduction devices more usable in various different applications and environments, particularly in those where a substantially continuous balance between active noise reduction and pass-through functionalities is desirable.

Figure 2:
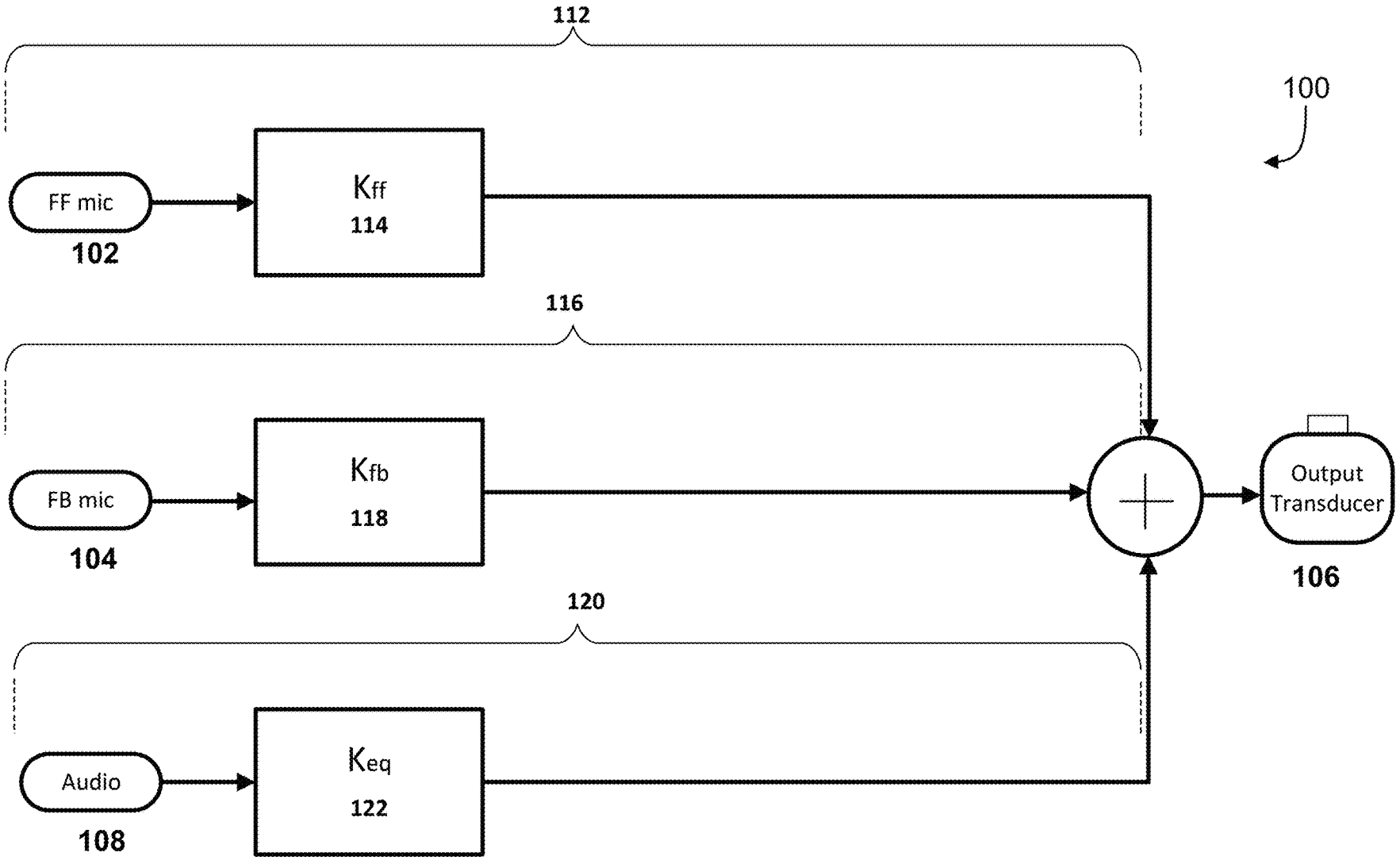
FIG. 2 is a block diagram of an example configuration of an active noise reduction device.

Various signal flow topologies can be implemented in an active noise reduction device to enable functionalities such as audio equalization, feedback noise cancellation, feedforward noise cancellation, etc. For example, as shown in the example block diagram of an active noise reduction device 110 in FIG. 2, the signal flow topologies can include a feedforward signal flow path 112 that drives the output transducer 106 to generate an anti-noise signal (using, for example, a feedforward compensator 114) to reduce the effects of a noise signal picked up by the feedforward microphone 102. In another example, the signal flow topologies can include a feedback signal flow path 116 that drives the output transducer 106 to generate an anti-noise signal (using, for example, a feedback compensator 118) to reduce the effects of a noise signal picked up by the feedback microphone 104. The signal flow topologies can also include an audio path 120 that includes circuitry (e.g., equalizer 122) for processing input audio signals 108 such as music or communication signals, for playback over the output transducer 106. Additional information about signal flow topologies for active noise reduction devices can be found in, e.g., U.S. patent application Ser. No. 16/124,056, filed on Sep. 6, 2018, the entire content of which is incorporated by reference.

Figure 3:
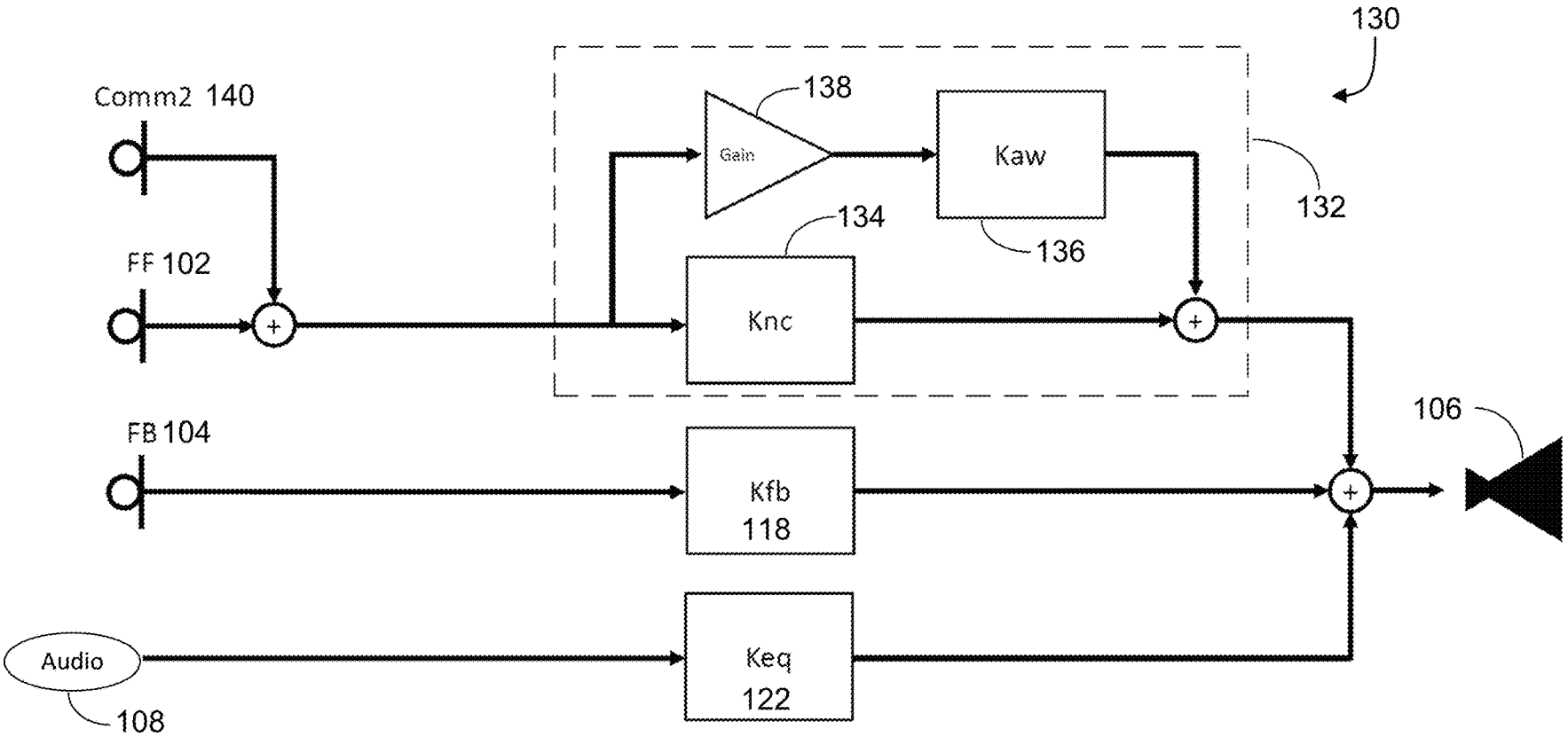
FIG. 3 is a block diagram of an example configuration of another active noise reduction device.

FIG. 3 is a block diagram of another example configuration of an active noise reduction device 130 that allows an audio signal from a communication device 140, e.g., a cell phone, to be inserted in the feedforward signal flow path 112 to enable the user to listen to audio from the communication device 140. The active noise reduction device 130 includes a feedforward compensator 132 in which an active noise reduction filter Knc 134 and a pass-through filter Kaw 136 are disposed in parallel, and a variable gain amplifier 138 provides an adjustable gain C for the pass-through filter Kaw 136. The two filters Knc 134 and Kaw 136 allow the user to control the amount of ambient noise and/or audio from the communication device 140 that can pass through the device. Additional information about the active noise reduction device 130 can be found in, e.g., U.S. patent application Ser. No. 15/710,354, filed on Sep. 20, 2017, the entire content of which is incorporated by reference.

Microphones are typically designed to achieve specific frequency response characteristics, such as specific low frequency roll-offs. For example, some microphones have a relatively flat signal gain above a certain frequency, but the gain is reduced as the frequency is reduced. The low frequency roll-off refers to the frequency at which the amplitude is reduced by 3 dB as compared to passband 158 (FIG. 4A), Due to variables in the manufacturing process, a batch of microphones of the same make and model may have slightly different frequency response characteristics. In some examples, the variations in the low frequency roll-off in a batch of MEMS microphones of the same make and model can be as high as, e.g., 30%. For example, for a MEMS microphone that is designed to have a nominal low frequency roll-off of 35 Hz, the actual measured low frequency roll-off can range from, e.g., 25 Hz to 45 Hz. The numbers 25 Hz, 35 Hz, and 45 Hz are merely examples, the nominal and measured low frequency roll-offs can have other values.

Figure 4A:
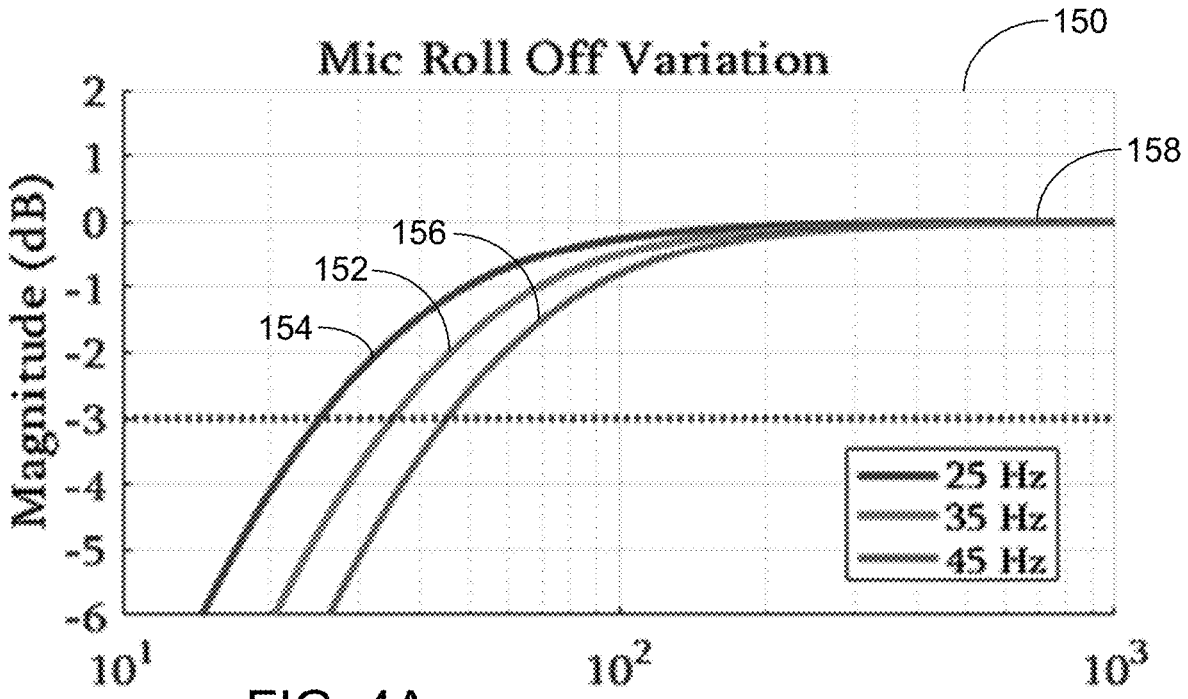
FIGS. 4A and 4B are graphs showing the variations in the amplitude and phase of microphone low frequency roll-off.
Figure 4B:
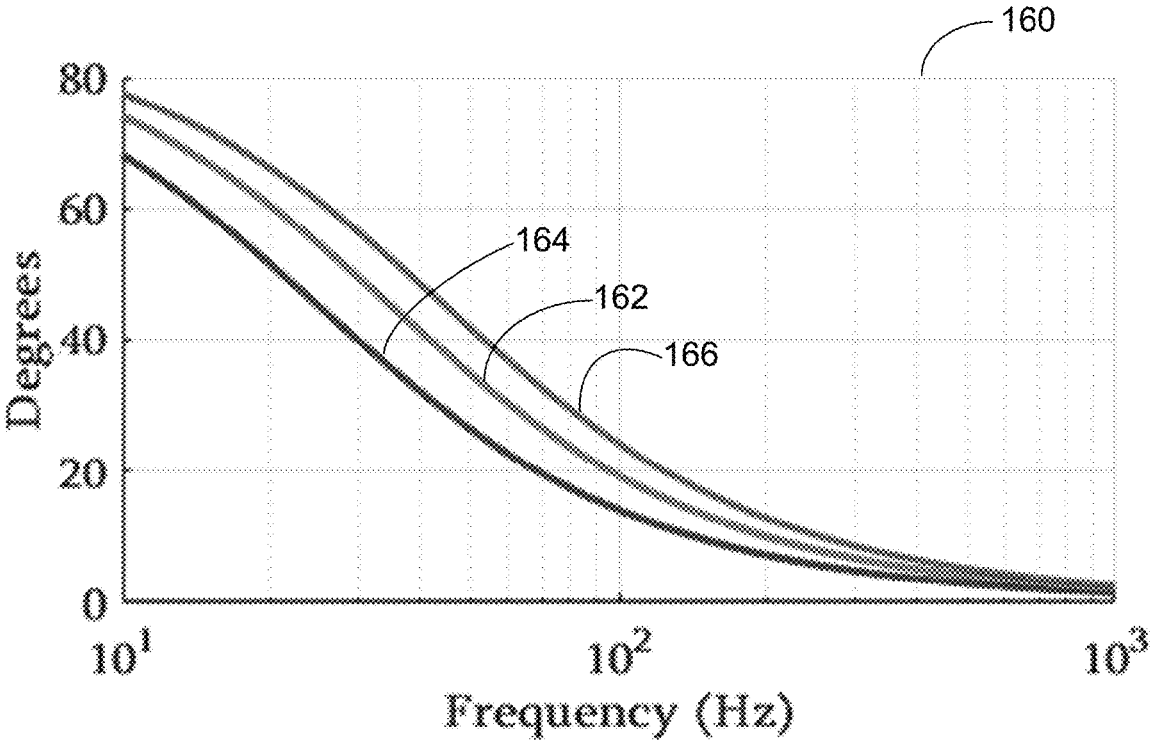

FIGS. 4A and 4B are graphs 150 and 160, respectively, that show examples of the amplitude and phase of the frequency responses for various MEMS microphones. In this example, it is assumed that the MEMS microphones are designed to have a nominal low frequency roll-off at 35 Hz. Referring to FIG. 4A, a curve 152 represents the amplitude of the frequency response of an ideal MEMS microphone having the nominal low frequency roll-off at 35 Hz. The curve 152 shows that the microphone has a relatively flat gain above about 300 Hz (pass band), and the gain is reduced below 300 Hz. A curve 154 represents the actual measured amplitude of the frequency response of a first MEMS microphone having a low frequency roll-off at 25 Hz. A curve 156 represents the actual measured amplitude of the frequency response of a second MEMS microphone having a low frequency roll-off at 45 Hz.

Referring to FIG. 4B, a curve 162 represents the phase of the frequency response of the ideal MEMS microphone having the nominal low frequency roll-off. A curve 164 represents the phase of the frequency response of the first MEMS microphone. A curve 166 represents the phase of the frequency response of the second MEMS microphone.

In the above example, even though the first and second MEMS microphones were designed to have low frequency roll-off at 35 Hz, due to manufacturing tolerances, their actual roll-off frequencies occur at 25 Hz and 45 Hz. When a company manufacturing the active noise reduction devices 100 purchases a large number of the microphones 102 and 104 from a supplier of the microphones, the company may not know in advance the exact low frequency roll-off of each individual microphone.

In some implementations, the active noise reduction filter Knc 134 and the pass-through filter Kaw 136 (FIG. 3) are designed to operate with a feedforward microphone 102 having a specified low frequency roll-off characteristic. The deviations in the amplitude and phase of the actual measured frequency response of the feedforward microphone 102 from the specified nominal frequency response may reduce the performance of the active noise reduction device 130. For example, suppose the active noise reduction device 130 is designed to use a feedforward microphone having low frequency roll-off at 35 Hz, but the actual measured low frequency roll-off of the microphone 102 is 25 Hz or 45 Hz, the noise cancellation effects may be reduced such that the user hears more noise, or the audio passed through the headset may change.

Figure 5:
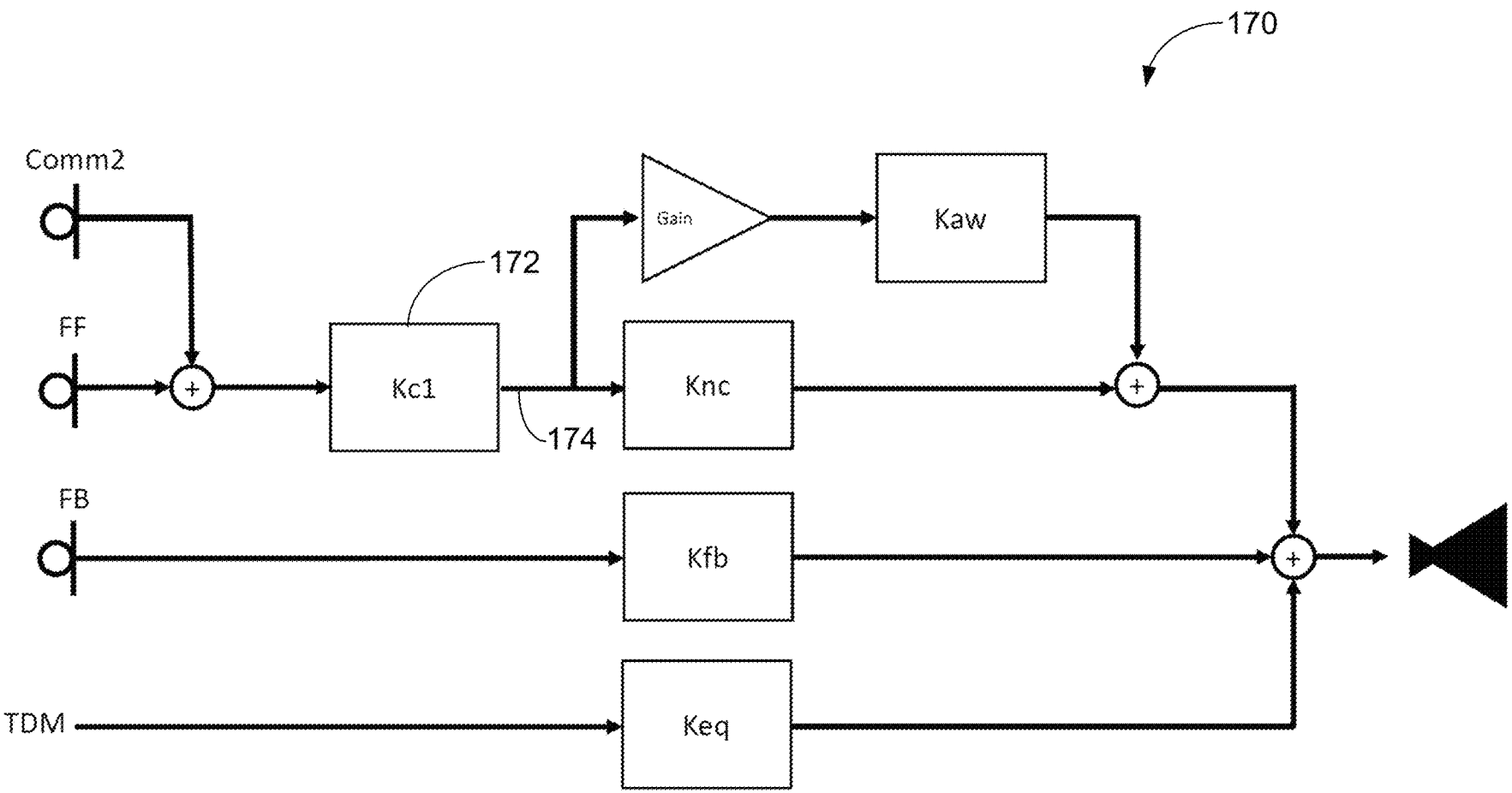
FIG. 5 is a block diagram of an example configuration of the active noise reduction device of FIG. 3 with compensation for roll-off variation.

Referring to FIG. 5, in some implementations, an active noise reduction device 170 includes a compensation module Kc1 172 that is configured to compensate for the deviation in the frequency response characteristic of the feedforward microphone 102. In this example, the compensation module 172 is implemented as a digital filter and will be referred to as a compensation filter 172. The goal of the compensation filter 172 is to cause the combination of the feedforward microphone 102 and the compensation filter 172 to have a frequency response that is similar to the specified frequency response of the feedforward microphone 102. For example, if the feedforward microphone 102 has a low frequency roll-off at 25 Hz, and the nominal or specified low frequency roll-off is 35 Hz, the compensation filter 172 is designed such that the combination of the feedforward microphone 102 and the compensation filter 172 will have a low frequency roll-off that is equal to or similar to 35 Hz. The compensation filter 172 generates an output 174 that is equal to or similar to the output of a feedforward microphone 102 that has the nominal low frequency roll-off.

Note that the compensation filter 172 is not used to compensate for the low frequency roll-off of the feedforward microphone 172 to make the gain in the lower frequency range (e.g., 10 Hz to 100 Hz) the same as the gain in the higher frequency range (e.g., >300 Hz). Rather, the compensation filter 172 is used to compensate for the deviation of the low frequency roll-off of the feedforward microphone 172 from its specified or nominal value.

The compensation filter 172 is configured to be easily customizable. Because different feedforward microphones 102 may have different low frequency roll-offs, the compensation filter 172 is individually adjusted to compensate for the particular feedforward microphone 102 that is paired with the compensation filter 172. Using a compensation filter 172 that is easily adjusted allows the manufacturing process for the active noise reduction device 170 to be more cost effective.

The compensation filter 172 is configured to have a transfer function that is approximately equal to the transfer function of the ideal microphone (having the specified or nominal low frequency roll-off) divided by the transfer function of the actual microphone (having the measured low frequency roll-off). For example, let F1 (z) represent the transfer function of the ideal microphone that has a nominal low frequency roll-off (e.g., at 35 Hz), F2(z) represent the transfer function of the actual microphone 102 (e.g., that has the low frequency roll-off at 25 Hz), and Kc(z) represent the transfer function of the compensation filter 172. The compensation filter 172 is configured such that Kc(z)=F1(z)/F2(z). This way, the transfer function of the combination of the feedforward microphone 102 and the compensation filter 172 will be F2(z)*(F1(z)/F2(z))=F1(z).

The transfer functions F1(z) and F2(z) can be found by, e.g., curve fitting. One can first find a mathematical function that has a shape similar to that of the frequency response of the microphone, and then adjust the coefficients of the function so that the shape of the function is as similar to the frequency response of the microphone as possible.

In some implementations, the function in Equation 1 below is approximately equal to F1(z)/F2(z) for an MEMS microphone having the frequency response characteristics shown in FIGS. 4A and 4B.

$$Kc = \frac{z + \left(\frac{2\pi f_{var}}{F_s} - 1\right)}{z + \left(\frac{2\pi f_{nom}}{F_s} - 1\right)} = \frac{z + (c_1 f_{var} - 1)}{z + (c_1 f_{nom} - 1)} \quad \text{(Equ. 1)}$$

In Equation 1 above, $f_{var}$ represents the measured low frequency roll-off of the feedforward microphone 102, $f_{nom}$ represents the specified or nominal low frequency roll-off of the microphone, Fs represents the sampling frequency, and c1 represents a gain value. In the example above, $f_{var}$=25 Hz, and $f_{nom}$=35 Hz. In some examples, the transfer function of the compensation filter can be different from the one in Equation 1.

In some implementations, the frequency response of a microphone may be different from those shown in FIGS. 4A and 4B. For example, the low frequency roll-off may be steeper (e.g., there is greater reduction in the gain for a given amount of reduction in frequency). Let F3(z) represent the transfer function of the ideal microphone of a second make and model that has a nominal low frequency roll-off, F4(z) represent the transfer function of the actual microphone of the second make and model (e.g., that has the low frequency roll-off different from the nominal value), and Kc'(z) represent the transfer function of the compensation filter. In this case, the compensation filter is configured such that Kc'(z) =F3 (z)/F4(z). This way, the transfer function of the combination of the feedforward microphone and the compensation filter will be F4(z)*(F3 (z)/F4(z))=F3 (z).

Figure 6:
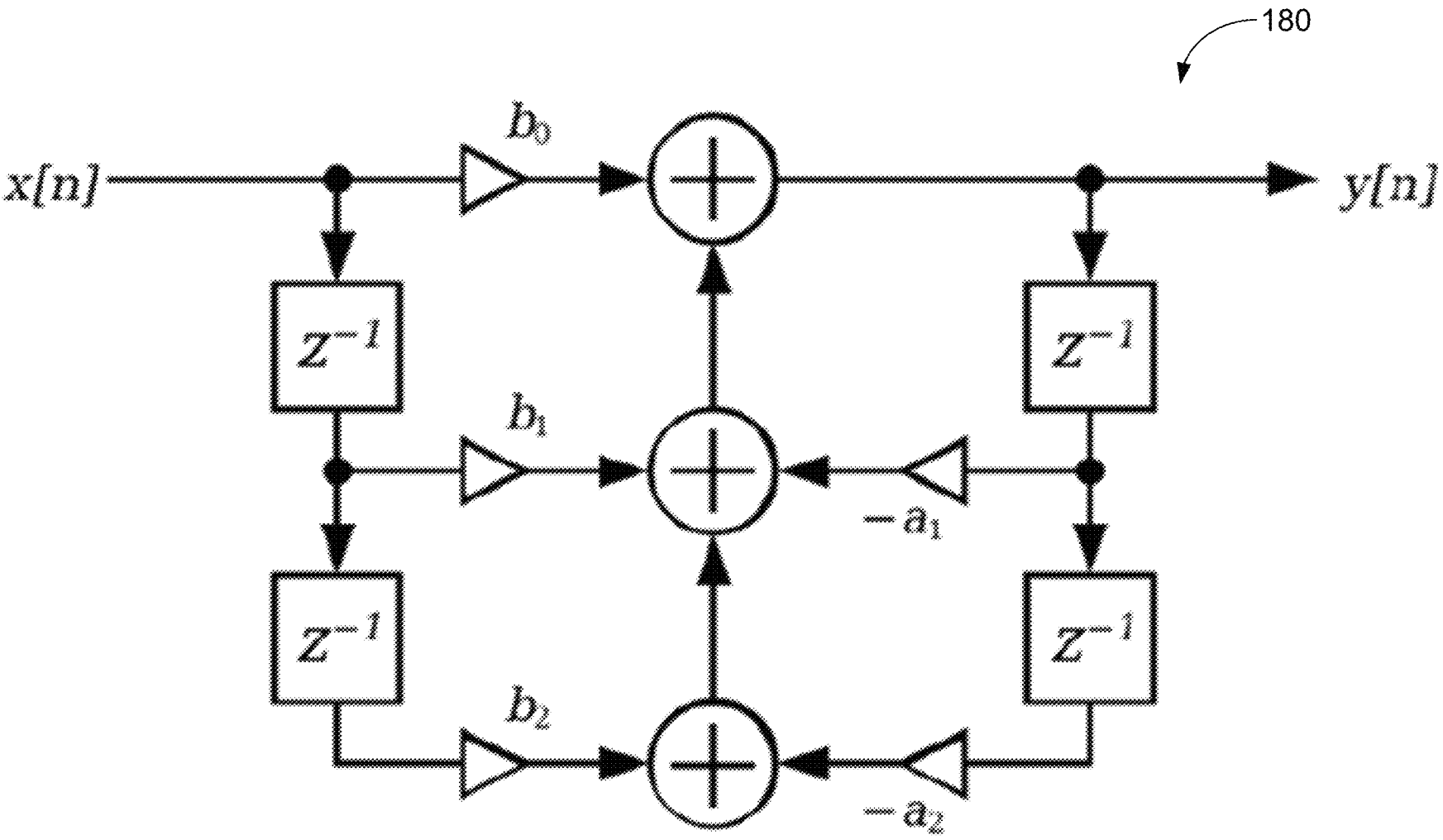
FIG. 6 is a schematic diagram of a digital bi-quad filter.

Referring to FIG. 6, in some examples, the compensation filter 172 can be implemented using a tunable bi-quad filter 180. The transfer function of the filter 180 is given by:

$$H(z) = \frac{b_0 + b_1 z^{-1} + b_2 z^{-2}}{1 + a_1 z^{-1} + a_2 z^{-2}} \quad \text{(Equ. 2)}$$

Additional information about the bi-quad filter 180 can be found in, e.g., U.S. patent application Ser. No. 15/473,889, filed on Mar. 30, 2017, published as U.S. Publication US2018/0286373, and U.S. patent application Ser. No. 15/473,926, filed on Mar. 30, 2017, published as U.S. Publication US2018/0286374, the entire contents of the above applications are incorporated by reference.

In some implementations, a digital signal processor is used to implement the bi-quad filter 180, and the coefficients of the filter 180 is represented by a filter coefficient matrix [b0, b1, b2, 1, a1, a2]. The user can adjust the transfer function of the bi-quad filter by changing the coefficient values in the filter coefficient matrix. The compensation filter 172 can be implemented by setting the values b0=1, b2=0, a1=−0.99755, and a2=0. The value of b1 can be set as follows:

$$b_1 = (a_1 + 1)\frac{f_{var}}{f_{nom}} - 1 \quad \text{(Equ. 3)}$$

$$b_1 = \left(\frac{f_{var}}{f_{nom}}a_1 + \frac{f_{var}}{f_{nom}}\right) - 1$$

During the manufacturing process of the active noise reduction device 170, the low frequency roll-off of the feedforward microphone 102 is measured to determine $f_{var}$, and the coefficient b1 in the filter coefficient matrix is determined using Equation 3. In the example above, if $f_{var}$=25 Hz and $f_{nom}$=35 Hz, then $$b1=(25/35*a1+25/35)-1=-0.99825.$$

If $f_{var}$=45 Hz and $f_{nom}$=35 Hz, then $$b1=(45/35*a1+45/35)-1=-0.99685.$$

The value of b1 for the filter coefficient matrix is stored in a storage device, e.g., flash memory accessible to the digital signal processor of the active noise reduction device 170. In general, the effect of the compensation filter Kc1 172 is to process the output of the feedforward microphone 102 having the low frequency roll-off $f_{var}$ to generate an output 174 that approximates or equals the output that would be generated by a feedforward microphone that has the nominal low frequency roll-off $f_{nom}$.

By using the bi-quad filter 180 to implement the compensation filter 172, the combination of the feedforward microphone 102 and the compensation filter 172 will, in most situations, have a frequency response that is more similar to the nominal frequency response of the microphone, than without using the compensation filter 172. Thus, the combination of the feedforward microphone 102 and the compensation filter 172 will have a low frequency roll-off that is, in most situations, closer to the nominal value (e.g., 35 Hz) than without using the compensation filter 172. If the measured low frequency roll-off of the feedforward microphone 102 is the same as the nominal value (e.g., 35 Hz), then b1=a1 and Kc(z)=1.

The bi-quad filter 180 described above is merely used as an example for implementing the compensation filter 172. Other types of compensation filters or compensation modules can also be used. For example, the compensation filter can be implemented using a digital filter having a transfer function different from Equation 2 and/or having filter coefficients different from those described above. For example, two or more compensation filters can be cascaded in series and/or used in parallel to achieve the desired compensation effect.

Figure 7:
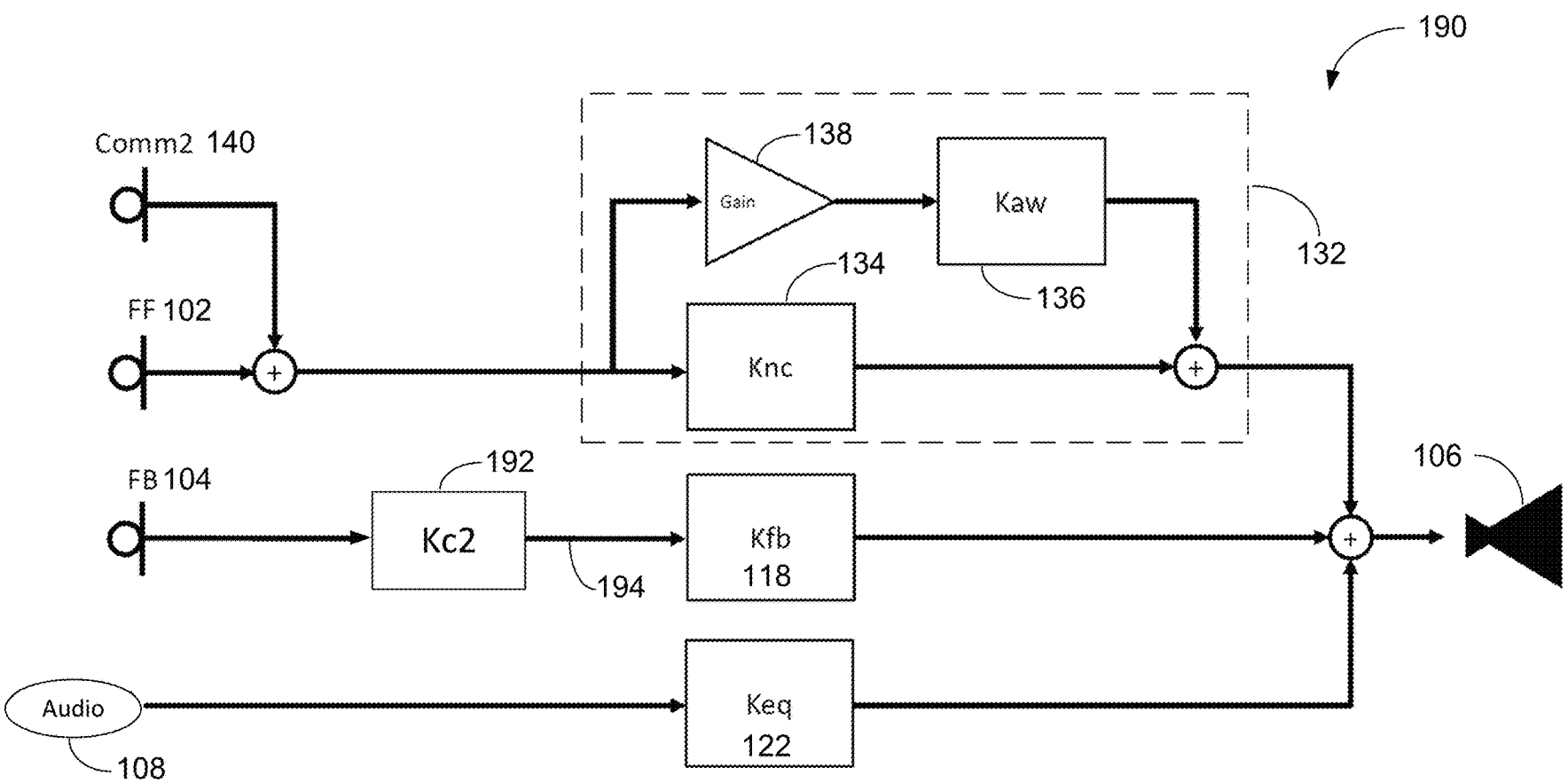
FIGS. 7 and 8 are block diagrams of example configurations of active noise reduction devices with compensation for microphone roll-off variations.

Referring to FIG. 7, in some implementations, an active noise reduction device 190 includes a compensation filter Kc2 192 that compensates for the variation in the low frequency roll-off from the nominal value for the feedback microphone 104. The function and design of the compensation filter Kc2 192 is similar to the compensation filter Kc1 172 in FIG. 5. The compensation filter Kc2 192 generates an output 194 that is similar to the output generated by a feedback microphone 104 having the nominal low frequency roll-off (i.e., the specified low frequency roll-off for the feedback microphone that the feedback compensator 118 is optimized to work with). During the manufacturing process of the active noise reduction device 190, the low frequency roll-off of the feedback microphone 104 is measured to determine $f_{var}$, and the coefficient b1 in the filter coefficient matrix is determined using Equation 3. Here, the nominal frequency $f_{nom}$ is that of the feedback microphone 104. The value of b1 for the filter coefficient matrix is stored in a storage device, e.g., flash memory accessible to the digital signal processor of the active noise reduction device 190.

Figure 8:
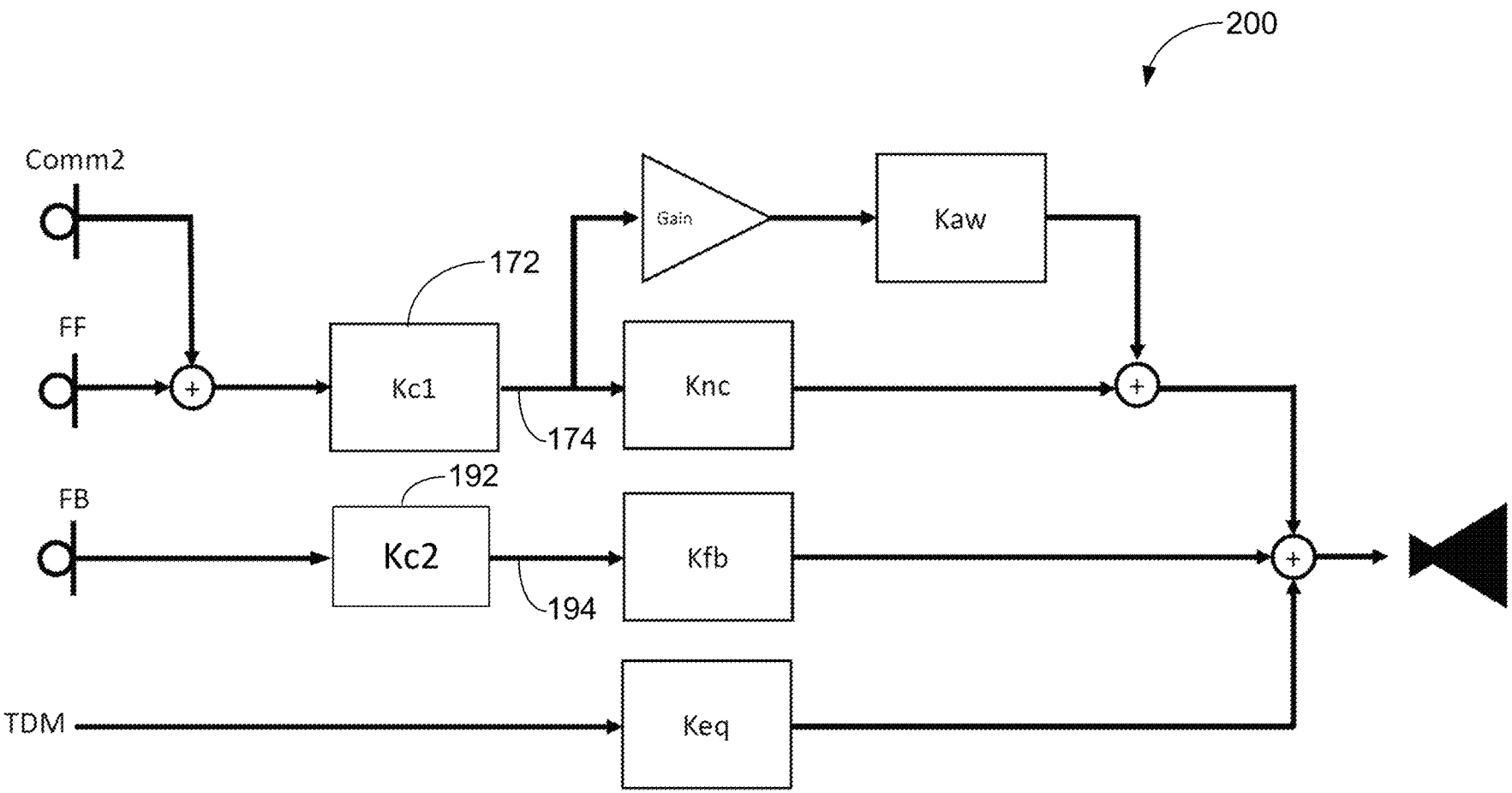

Referring to FIG. 8, in some implementations, an active noise reduction device 200 includes both the compensation filter Kc1 172 and the compensation filter Kc2 192 to compensate the variations in the low frequency roll-offs from the nominal values of the feedforward microphone 102 and the feedback microphone 104, respectively. During the manufacturing process of the active noise reduction device 200, the low frequency roll-offs of both the feedforward microphone 102 and the feedback microphone 104 are measured, and the coefficients in the filter coefficient matrices for the compensation filters Kc1 and Kc2 are calculated and stored in a storage device, e.g., flash memory accessible to the digital signal processor of the active noise reduction device 200.

In some implementations, the active noise reduction device can have a feedforward signal flow path and a feedback signal flow path that are different from those shown in FIGS. 2, 3, 5, 7, and 8. For example, FIGS. 2B and 3B of U.S. patent application Ser. No. 15/710,354 and FIGS. 3A-3C of U.S. patent application Ser. No. 16/124,056 show additional signal flow topologies for an active noise reduction device. The compensation filter Kc1 172 and/or the compensation filter Kc2 192 can also be used in the active noise reduction device having the signal flow topology shown in FIG. 2B or 3B of U.S. patent application Ser. No. 15/710,354 and FIGS. 3A-3C of U.S. patent application Ser. No. 16/124,056.

The compensation filter Kc1 172 and/or the compensation filter Kc2 192 can be used in active noise cancellation systems installed in, e.g., vehicles or airplanes that use speakers to generate anti-noise signals to reduce the noise heard by the drivers or pilots. A vehicle or airplane can have multiple feedforward and feedback microphones to detect sound at various locations in the vehicle or airplane, and a compensation filter can be provided for each microphone to compensate for variations in the low frequency roll-offs from the nominal values.

Figure 9:
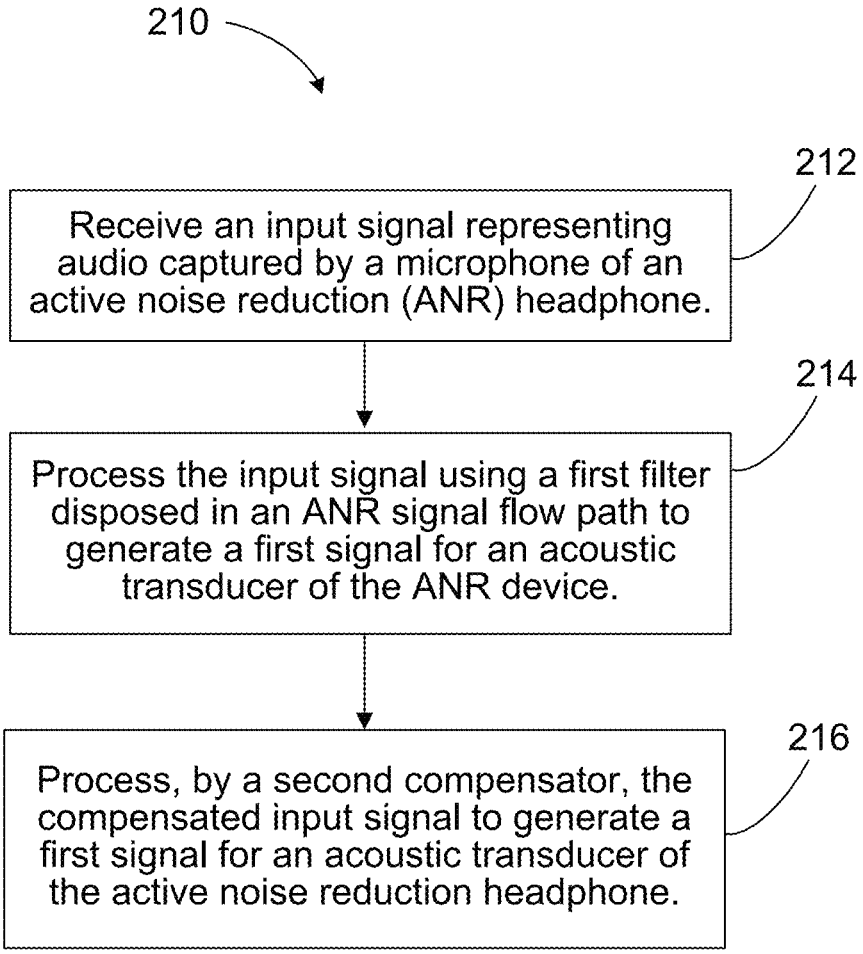
FIG. 9 is a flow diagram of a process for generating an output signal in an active noise reduction device.

FIG. 9 is a flowchart of an example process 210 for generating an output signal in an active noise reduction device. At least a portion of the process 210 can be implemented using one or more processing devices such as digital signal processors described in U.S. Pat. Nos. 8,073,150 and 8,073,151. Operations of the process 210 include receiving an input signal representing audio captured by a microphone of an active noise reduction device, such as an active noise reduction headphone (212). For example, the microphone can be the feedforward microphone 102 or the feedback microphone 104 of the active noise reduction device 170, 190, or 200. For example, the active noise reduction device can include an around-the-ear headphone, an over-the-ear headphone, an open-ear headphone, a hearing aid, or another personal acoustic device.

Operations of the process 210 also include processing, by a first compensator, the input signal to generate a compensated input signal, in which processing the input signal comprises compensating a difference between the measured roll-off frequency and a predetermined or nominal roll-off frequency for the microphone (214). The input signal can be the signal output from the feedforward microphone 102 or the feedback microphone 104. The first compensator can be, e.g., the compensation filter 172 or 192. The first compensator can be, e.g., a bi-quad filter.

Operations of the process 400 further include processing, by a second compensator, the compensated input signal to generate a first signal for an acoustic transducer of the active noise reduction headphone (216). In some examples, the compensated input signal can be the output signal 174 of the compensation filter Kc1 172 and the second compensator can be the feedforward compensator 132. In some examples, the compensated input signal can be the output signal 194 of the compensation filter Kc2 192, and the second compensator can be the feedback compensator Kfb 118. The acoustic transducer can be, e.g., the output transducer 106, which can be a speaker.

Figure 10:
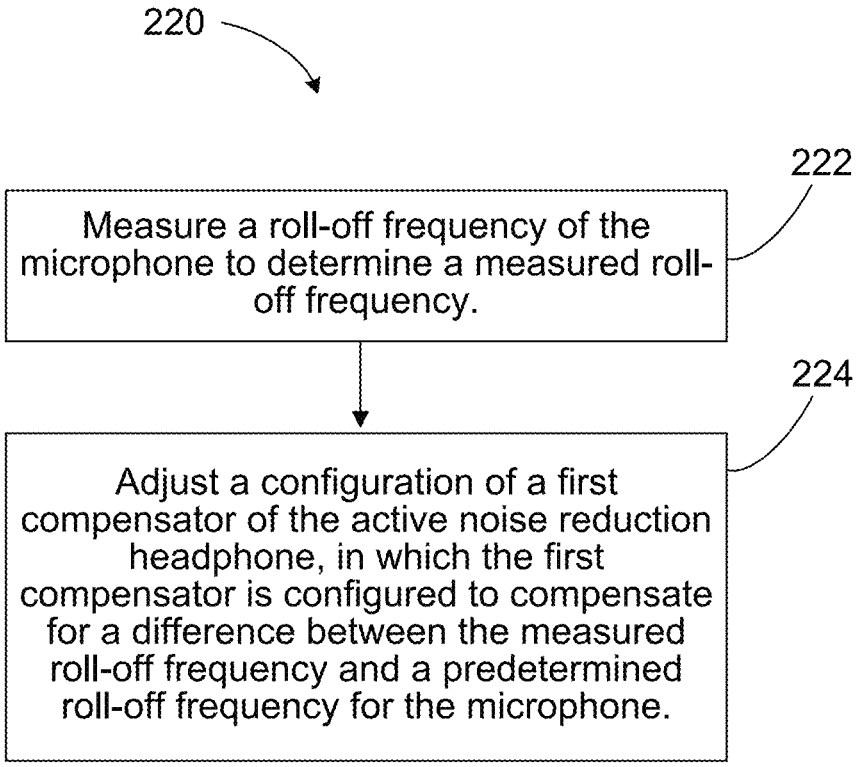
FIG. 10 is a flowchart of an example process for calibrating an active noise reduction headphone having a microphone.

FIG. 10 is a flowchart of an example process 220 for calibrating an active noise reduction headphone having a microphone. At least a portion of the process 210 can be implemented using one or more processing devices such as digital signal processors described in U.S. Pat. Nos. 8,073,150 and 8,073,151. Operations of the process 220 include measuring a roll-off frequency of the microphone to determine a measured roll-off frequency (222). For example, the microphone can be the feedforward microphone 102 or the feedback microphone 104 of the active noise reduction device 170, 190, or 200. For example, the roll-off frequency can be the low frequency roll-off of the microphone 102 or 104. In some examples, the low frequency roll-off of the microphone 102 or 104 can be measured before the microphone is assembled with other components to form an assembled active noise reduction device. In some examples, the low frequency roll-off of the microphone 102 or 104 can be measured after the microphone is assembled with other components to form the assembled active noise reduction device. For example, the active noise reduction device can include an around-the-ear headphone, an over-the-ear headphone, an open-ear headphone, a hearing aid, or another personal acoustic device.

Operations of the process 220 also include adjusting a configuration of a first compensator of the active noise reduction headphone, in which the first compensator is configured to compensate for a difference between the measured roll-off frequency and a predetermined or nominal roll-off frequency for the microphone (224). For example, adjusting the configuration of the first compensator can include adjusting a coefficient in the filter coefficient matrix for the first compensator, such as the coefficient b1 in Equations 2 and 3. For example, the microphone can be the feedforward microphone 102, and the first compensator can be the compensation filter Kc1 172. For example, the microphone can be the feedback microphone 104, and the first compensator can be the compensation filter Kc2 192.

Figure 11:
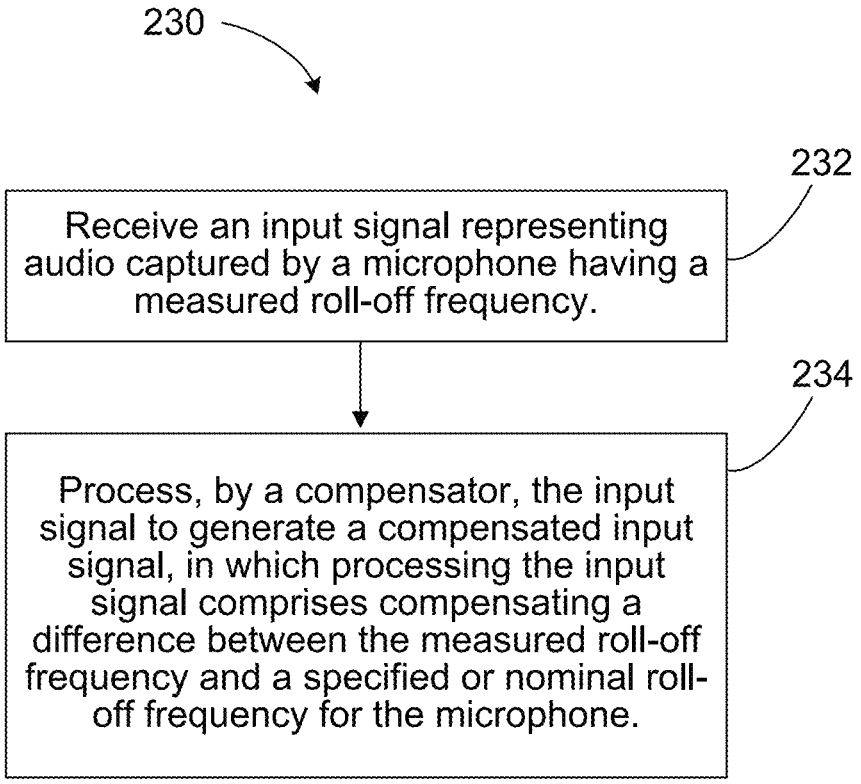
FIG. 11 is a flowchart of an example process for operating an electronic device having a microphone.

FIG. 11 is a flowchart of an example process 230 for operating an electronic device having a microphone. At least a portion of the process 230 can be implemented using one or more processing devices such as digital signal processors described in U.S. Pat. Nos. 8,073,150 and 8,073,151. Operations of the process 230 include receiving an input signal representing audio captured by a microphone having a measured roll-off frequency (232). For example, the microphone can be the feedforward microphone 102 or the feedback microphone 104 of the active noise reduction device 170, 190, or 200.

Operations of the process 210 also include processing, by a compensator, the input signal to generate a compensated input signal, in which processing the input signal comprises compensating a difference between the measured roll-off frequency and a specified or nominal roll-off frequency for the microphone (234). The input signal can be the signal output from the feedforward microphone 102 or the feedback microphone 104. The compensator can be, e.g., the compensation filter 172 or 192. The compensator can be, e.g., a bi-quad filter.

Figure 12:
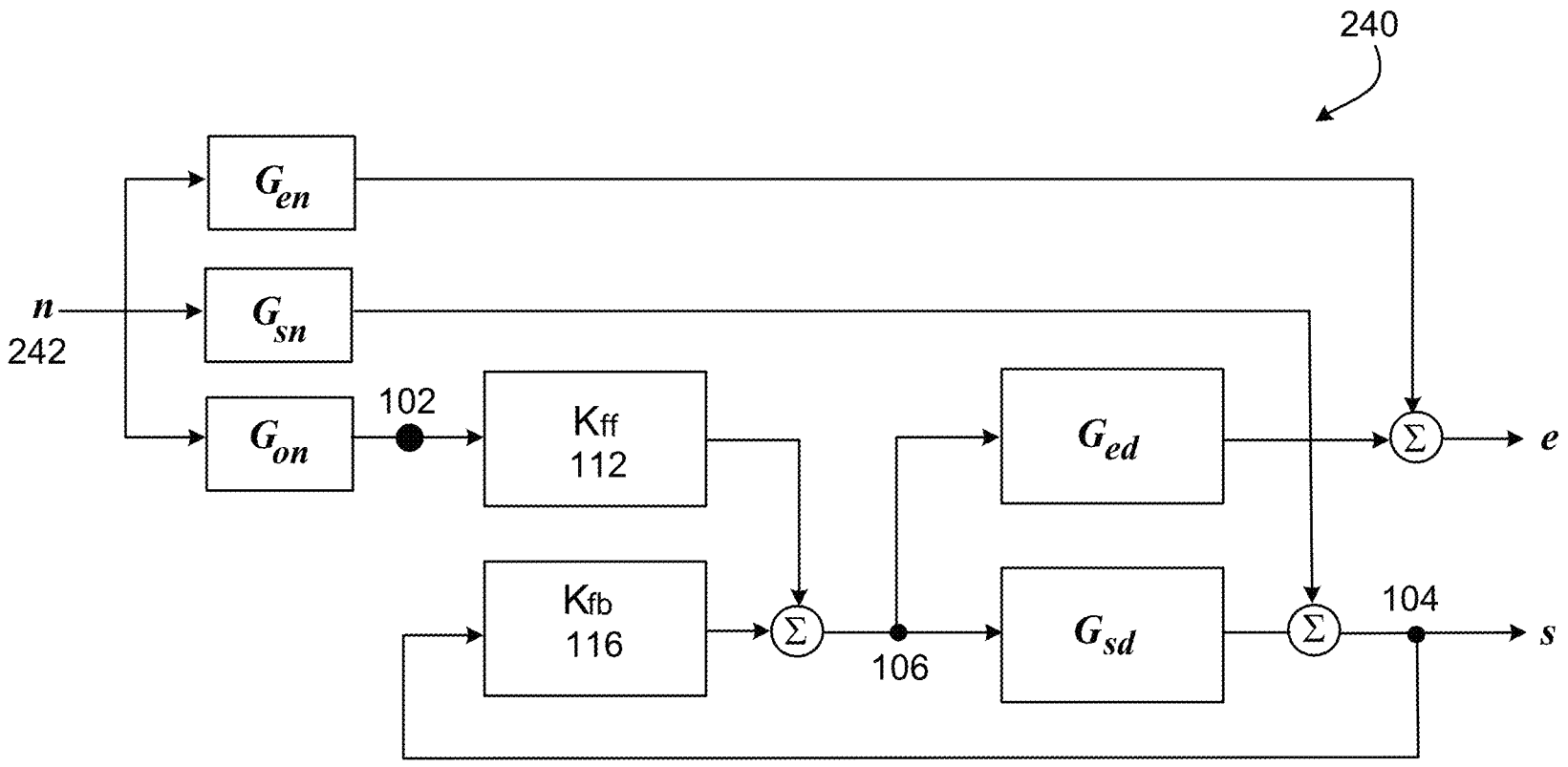
FIGS. 12 and 13 are block diagrams of example configurations of active noise reduction devices.

The following describes additional examples of configurations for active noise reduction devices. FIG. 12 is a block diagram of an example configuration 240 of an active noise reduction device. For the sake of brevity, the example configuration 240 does not show an audio path akin to the audio path 118 shown in FIG. 2. The configuration 240 also shows the transfer function $G_{sd}$ that represents the acoustic path between the acoustic transducer 106 and the feedback microphone 104 (which may also be referred to as the system microphone or sensor s). The transfer function $G_{ed}$ represents the acoustic path between the driver d (or the acoustic transducer 106) and the microphone e disposed proximate to the ear of the user. The microphone e measures the noise at the ear of the user. The microphone may be inserted in the ear canal of a user during the system design process, but may not be a part of the active noise reduction device itself. The noise n represents an input to the configuration 240. The transfer function between a noise source 242 and the feedforward microphone 102 is represented by $G_{on}$, such that the noise, as captured by the feedforward microphone 102, is represented as $n \times G_{on}$. The transfer functions of the acoustic paths between (i) the noise source 242 and the feedback microphone 104, and (ii) the noise source and the ear e are represented as $G_{sn}$ and $G_{en}$, respectively.

The relationships between the various sensors or microphones, and the two sources of audio (the noise source 242 and the acoustic transducer 106) can therefore be expressed using the following equations:

$$d = K_{fb}s + K_{ff}o \quad \text{(Equ. 4)}$$

$$s = G_{sd}d + G_{sn}n \quad \text{(Equ. 5)}$$

$$e = G_{ed}d + G_{en}n \quad \text{(Equ. 6)}$$

$$o = G_{on}n \quad \text{(Equ. 7)}$$

Therefore, the ratio of noise measured at the feedback microphone 104 relative to the noise n is given by:

$$\frac{8}{n} = \frac{K_{ff}G_{sd}G_{on} + G_{sn}}{1 - K_{fb}G_{sd}} \quad \text{(Equ. 8)}$$

Similarly, the noise measured at the ear (e) relative to the disturbance noise n is given by:

$$\frac{e}{n} = G_{en}\left[1 + G_{ed}\frac{\left(\frac{G_{sn}}{G_{en}}\right)K_{fb} + \left(\frac{G_{on}}{G_{en}}\right)K_{ff}}{1 - K_{fb}G_{sd}}\right] \quad \text{(Equ. 9)}$$

As a reference, the open-ear response to the noise can be defined as:

$$\left.\frac{e}{n}\right|_{open} \equiv \left.G_{en}\right|_{O} \quad \text{(Equ. 10)}$$

The total performance of the active noise reduction device (e.g., an active noise reduction headphone) can be expressed in terms of a target Insertion Gain (IG), which is the ratio of: (i) the noise at the ear relative to the noise when the device is active and being worn by a user, and (ii) the reference open-ear response. This is given by:

$$IG = PIG\left[1 + G_{ed}\frac{\left(\frac{G_{sn}}{G_{en}}\right)K_{fb} + \left(\frac{G_{on}}{G_{en}}\right)K_{ff}}{1 - K_{fb}G_{sd}}\right] \quad \text{(Equ. 11)}$$

where the passive insertion gain (PIG) is defined as the purely passive response of the active noise reduction device when it is worn by the user. The PIG is given by:

$$PIG \equiv \frac{G_{en}}{G_{en}|_{O}} \quad \text{(Equ. 12)}$$

In some implementations, where the noise is measured at a point with an omni-directional reference microphone, the expressions in Equations 11 and 12 may be evaluated as energy ratios (e.g., without considering the phase) measured at the ear microphone before and after the user wearing the active noise reduction device, with the active noise reduction device in either active or passive mode, respectively.

In some implementations, the various noise disturbance terms may be expressed as normalized cross spectra between the available microphones as:

$$N_{so} \equiv \frac{G_{sn}}{G_{on}},\ N_{eo} \equiv \frac{G_{en}}{G_{on}},\ N_{es} \equiv \frac{G_{en}}{G_{sn}} \quad \text{(Equ. 13)}$$

Using these expressions, Equation 11 may be rewritten as:

$$IG = PIG\left[1 + \left(\frac{G_{ed}}{N_{eo}}\right)\frac{N_{so}K_{fb} + K_{ff}}{1 - K_{fb}G_{sd}}\right] \quad \text{(Equ. 14)}$$

Equation 14 relates the total insertion gain (which may be referred to as the target insertion gain) of an active noise reduction device to the measured acoustics of the system, and the associated feedforward compensator 114 and feedback compensator 118, $K_{ff}$ and $K_{fb}$, respectively. In some implementations, for a given fixed feedback compensator 118, Equation 14 may therefore be used to compute corresponding feedforward compensators 114 for specified values of target insertion gains and the other parameters. For example, the target insertion gain can be set to 0 to obtain a feedforward compensator 114 configured to provide full active noise reduction (maximum noise cancellation) for the given device. Such a filter or feedforward compensator may be denoted as $K_{nc}$. Conversely, the target insertion gain can be set to 1 to obtain a feedforward compensator 114 that passes the signals captured by the feedforward microphone 102 with unity gain. Such a filter or feedforward compensator is referred to herein as an "aware mode" or "pass-through" filter, and is denoted as $K_{aw}$.

In some implementations, to allow for intermediate target insertion gains between 0 and 1, and allow a user to control the amount of ambient noise passed through the device, the two filters $K_{nc}$ and $K_{aw}$ can be disposed in parallel in the feedforward signal flow path, as previously shown in FIG. 3. The example configuration of FIG. 3 shows the feedforward compensator 132 in which the active noise reduction filter 134 and the pass-through filter 136 are disposed in parallel, with the gain of the pass-through filter being adjustable by a factor C. The adjustable gain C may be implemented using the variable gain amplifier 138 disposed in the pass-through signal flow path of the feedforward compensator 132. The overall transfer function of the feedforward compensator 132 may be represented as:

$$K_{ff} = K_{nc} + C \times K_{aw} \quad \text{(Equ. 15)}$$

The parallel structure of the active noise reduction filter and the pass-through filter may be implemented in various ways. In some implementations, each of the active noise reduction filter and the pass-through filter can be substantially fixed, and the adjustable factor can be based on user-input indicative of an amount of ambient noise and sounds that the user intends to hear. This may represent an efficient and low complexity implementation, particularly for applications where the contribution of one of the signal flow paths (the active noise reduction signal flow path or the pass-through signal flow path) is expected to dominate the final output. This can happen, for example, when the value of C is expected to be close to either 0 or 1. In such cases, the magnitude responses of the individual paths may not deviate significantly from corresponding design values. For example, the magnitude response of each of the active noise reduction signal flow path and the pass-through signal flow path may be designed in accordance with a set of target spectral characteristics (e.g., spectral flatness), and when one of the paths dominate the output, the paths may not deviate significantly from the corresponding target flatness.

The design of the feedforward compensator 132 may be optimized for a feedforward microphone 102 that has a specified or nominal low frequency roll-off. If the actual or measured low frequency roll-off of the feedforward microphone 102 is different form the specified or nominal low frequency roll-off, the active noise reduction signal flow path and the pass-through signal flow path may not be able to achieve the set of target spectral characteristics (e.g., spectral flatness).

Figure 13:
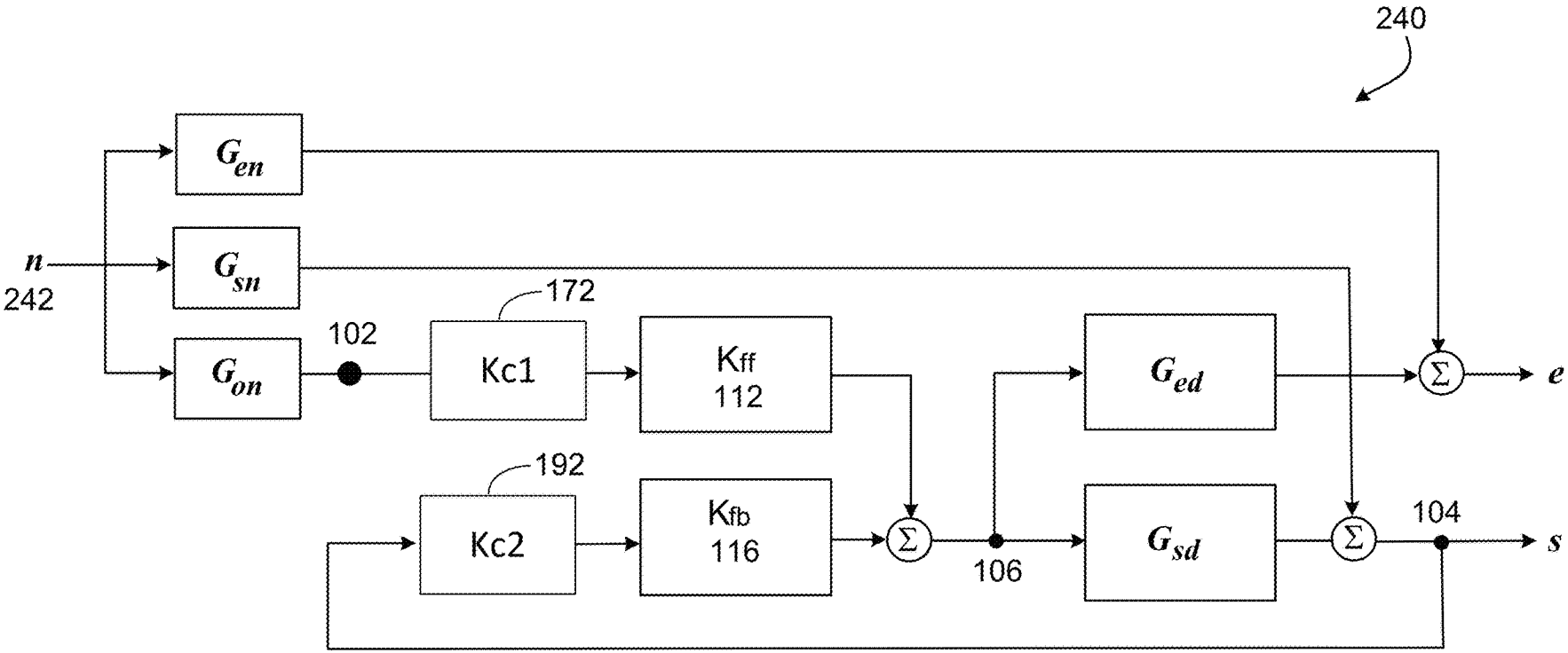

Referring to FIG. 13, the compensation filter Kc1 172 is added to the feedforward signal flow path, and the compensation filter Kc2 192 is added to the feedback signal flow path of the active noise reduction device. By using the compensation filter Kc1 172, the combination of the feedforward microphone 102 and the compensation filter Kc1 172 has the specified or nominal low frequency roll-off of the feedforward microphone 102, allowing the active noise reduction signal flow path and the pass-through signal flow path to achieve the set of target spectral characteristics (e.g., spectral flatness). Similarly, the combination of the feedback microphone 104 and the compensation filter Kc2 192 has the specified or nominal low frequency roll-off of the feedback microphone 104, allowing the feedback noise reduction signal flow path to be able to achieve the target spectral characteristics.

In some implementations, when the individual gains of the active noise reduction path and the pass-through path approach one another, the phase responses of the individual paths may interfere constructively or destructively, thereby potentially making the corresponding magnitude responses deviate significantly from the design values. For example, the interference of the phase responses of the two paths may, in some cases, degrade the target flatness of the corresponding magnitude responses. This in turn may degrade the performance of the active noise reduction device.

In some implementations, the effect of interference between the phase responses of the two paths may be mitigated by using a filter bank in at least one of the two signal flow paths disposed in parallel. For example, the active noise reduction filter 134 can include a filter bank that includes a plurality of selectable digital filters, wherein each digital filter in the filter bank corresponds to a particular value of C. In some implementations, the pass-through filter 136 may include a similar filter bank. In such cases, a change in the value of C can prompt a change in one or more of the active noise reduction filter 134 and the pass-through filter 136. The filters can be selected (or computed in real time based on the value of C), for example, such that any interference between the resulting phase responses do not degrade the spectral characteristics (e.g., flatness) of the magnitude response beyond a target tolerance limit.

In some implementations, instead of obtaining a $K_{nc}$ and a $K_{aw}$ separately for two different values of insertion gain, and adding the two filters together, the insertion gain can be kept as a free parameter to obtain two separate filters that are independent of any particular insertion gain. For example, solving for $K_{ff}$ using Equation 14 yields:

$$K_{ff} = -\left[K_{fb}N_{so} + (1 - K_{fb}G_{sd})\left(\frac{N_{eo}}{G_{ed}}\right)\right] + IG\left[\frac{1 - K_{fb}G_{sd}}{PIG}\left(\frac{N_{eo}}{G_{ed}}\right)\right] \quad \text{(Equ. 16)}$$

which may be represented as:

$$K_{ff} = K_{nc} + IG\,K_{aw} \quad \text{(Equ. 17)}$$

In Equation 17, $K_{nc}$ equals the first term in the right hand side of Equation 16, and represents a noise cancellation filter. $K_{aw}$ equals the second term in the right hand side of Equation 16 and represents a pass-through filter.

Figure 14:
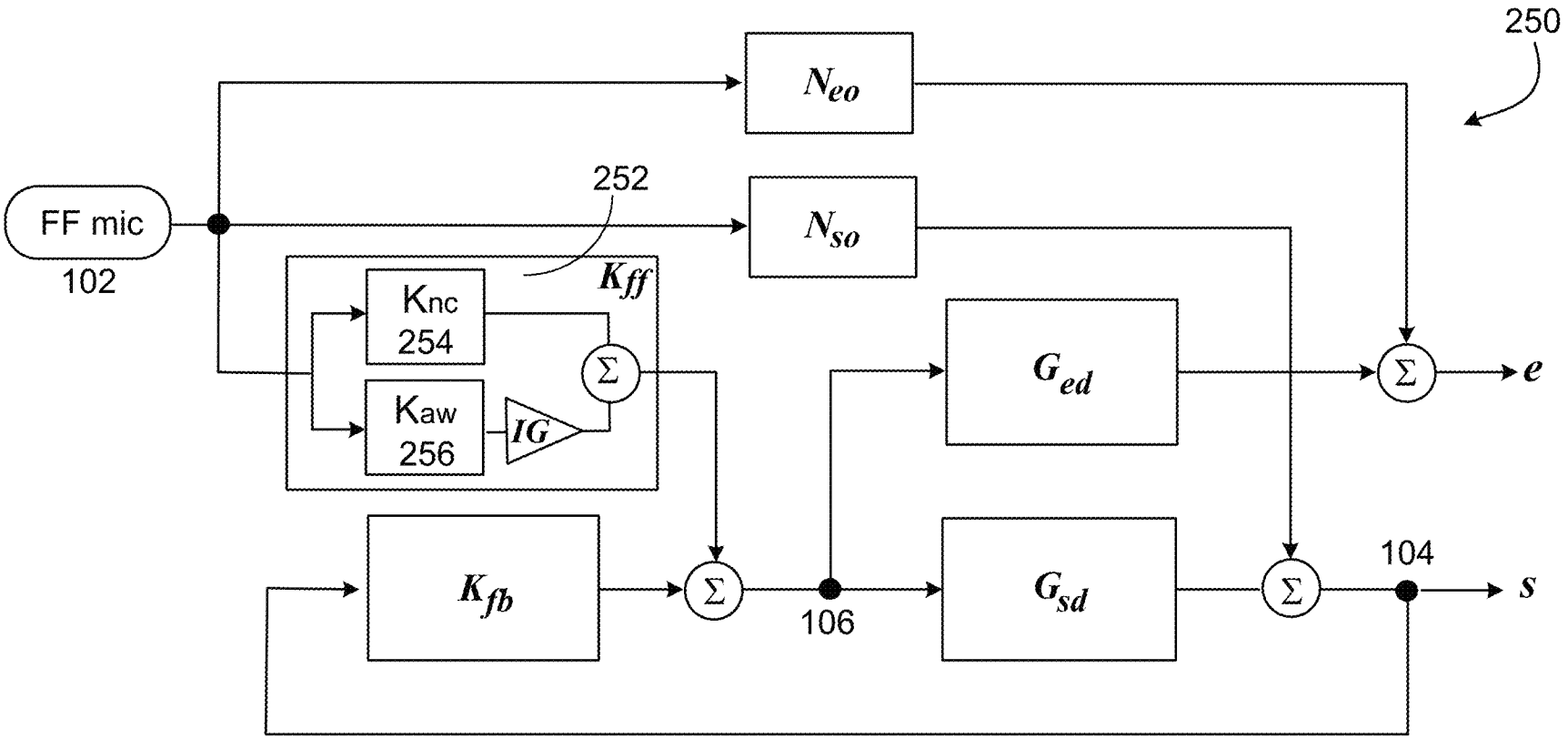
FIGS. 14 and 15 are block diagrams of example configurations of active noise reduction devices that include an active noise reduction signal flow path disposed in parallel to a pass-through signal flow path.

FIG. 14 is a block diagram of an example configuration 250 of an active noise reduction device that includes an active noise reduction signal flow path disposed in parallel to a pass-through signal flow path in accordance with Equation 17 within a feedforward compensator 252. Specifically, the active noise reduction signal flow path includes the active noise reduction filter 254 and the pass-through signal flow path includes the pass-through filter 256, wherein the filters 254 and 256 are obtained in accordance with Equations 16 and 17. The transfer functions $N_{eo}$ and $N_{so}$ are defined above in Equation 13.

In some implementations, the feedforward compensator 252 shown in FIG. 13 may provide one or more advantages. For example, because the filters 254 and 256 can be implemented as fixed coefficient filters, the need for any filter bank may be obviated. This in turn may allow for the feedforward compensator 252 to be implemented using lower processing power and/or storage requirements. This may be particularly advantageous in smaller form-factor active noise reduction devices that have limited processing power and/or storage space on-board. Further, because the phase responses of the two parallel paths are not dependent on the insertion gain, the magnitude responses may remain substantially invariant to the insertion gain IG. For example, the insertion gain may not significantly affect the flatness or other spectral characteristics of the magnitude responses associated with the two parallel paths when the insertion gains are varied over a range. In some implementations, the feedforward compensator can be configured to support arbitrary values of the insertion gain IG, including for example, values large than unity that can be used to amplify the ambient sounds. This can be useful, for example, in devices such as hearing aids, and/or to hear ambient sounds that may not be otherwise audible. For example, in order to better hear audio emanating from a distant source, a user may temporarily turn up the gain such that the IG value is more than unity.

Figure 15:
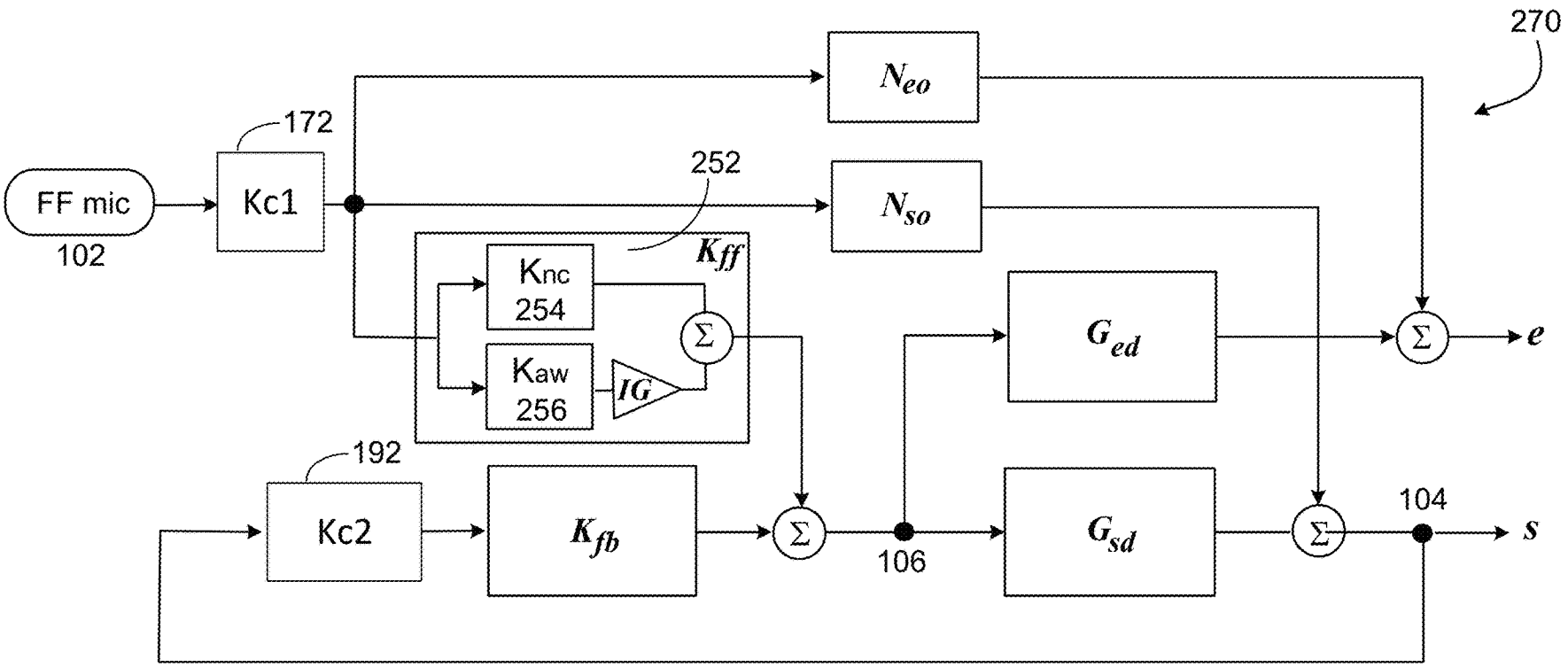

Referring to FIG. 15, an active noise reduction device 270 includes a compensation filter 172 and a compensation filter 192 that have been added to the feedforward signal flow path and the feedback signal for path, respectively. By using the compensation filter Kc1 172, the combination of the feedforward microphone 102 and the compensation filter Kc1 172 has the specified or nominal low frequency roll-off of the feedforward microphone 102. Similarly, the combination of the feedback microphone 104 and the compensation filter Kc2 192 has the specified or nominal low frequency roll-off of the feedback microphone 104. This allows the active noise reduction device 270 to perform in an optimal manner even though the low frequency roll-offs of the feedforward microphone 102 and the feedback microphone 104 are different from their nominal values.

Figure 16:
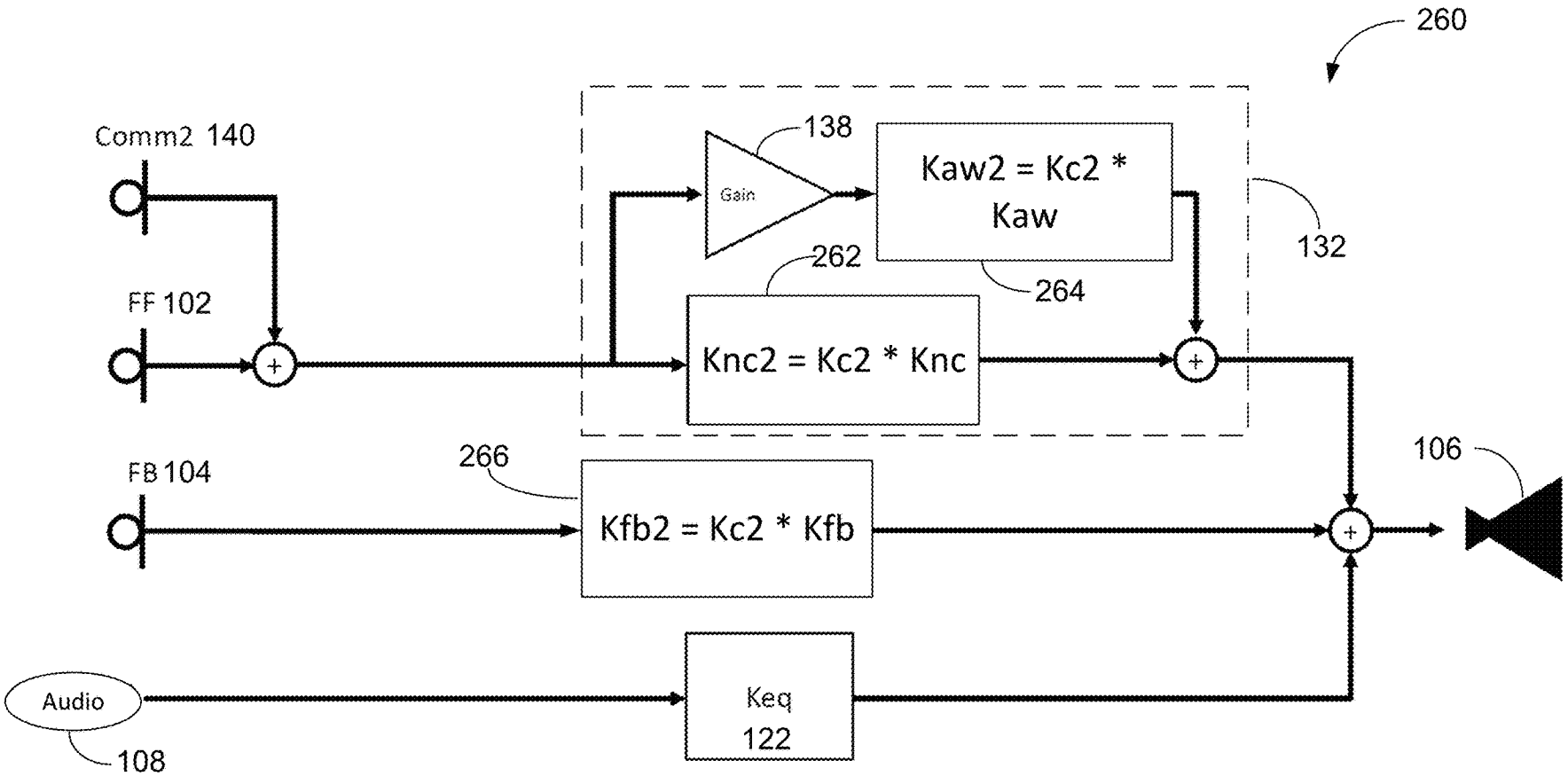
FIG. 16 is a block diagram of an example configuration of an active noise reduction device with compensation for microphone roll-off variation.

Referring to FIG. 16, in some implementations, the compensation filters connected in series can be combined. An active noise reduction device 260 includes an active noise reduction filter Knc2 262 that is a combination of the compensation module Kc1 172 and the active noise reduction filter Knc 134, in which $$Knc2 = Kc1 * Knc.$$

The active noise reduction device 260 includes a pass-through filter Kaw2 264 that is a combination of the compensation module Kc1 172 and the pass-through filter Kaw 136, in which $$Kaw2 = Kc1 * Kaw.$$

The active noise reduction device 260 includes a feedback filter Kfb2 266 that is a combination of the compensation module Kc2 192 and the feedback filter Kfb 118, in which $$Kfb2 = Kc2 * Kfb.$$

The active noise reduction device 260 functions in a similar manner as the active noise reduction device 200 of FIG. 8.

Various modifications or combinations of the above modules are possible. For example, the active noise reduction device 260 can be modified to use the feedback filter Kfb 118 in the feedback signal flow path, and use filters Knc2 and Kaw2 in the feedforward signal flow path. For example, the active noise reduction device 260 can be modified to use the active noise reduction filter Knc 134 and the pass-through filter Kaw 135 in the feedforward signal flow path, and use the feedback filter Kfb2 in the feedback signal flow path. For example, the active noise reduction device 260 can be modified to use to use the compensation module Kc2 192 and the feedback filter Kfb 118 in the feedback signal flow path, and use filters Knc2 262 and Kaw2 264 in the feedforward signal flow path. For example, the active noise reduction device 260 can be modified to use to use the compensation module Kfb2 266 in the feedback signal flow path, and use the compensation module Kc1 172 and filters Knc 134 and Kaw 136 in the feedforward signal flow path.

In some examples, a headphone includes a left active noise reduction device and a right active noise reduction device. The microphones in the left active noise reduction device may have a low frequency roll-offs that are different from those of the microphones in the right active noise reduction device. The compensation filters Kc1 172 and Kc2 192 are useful to ensure that the noise cancellation effects in both the left active noise reduction device and the right active noise reduction device are similarly optimized.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program or software can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

The software may be provided on a medium, such as a CD-ROM, DVD-ROM, or Blu-ray disc, readable by a general or special purpose programmable computer or delivered (encoded in a propagated signal) over a network to the computer where it is executed. The software may be implemented in a distributed manner in which different parts of the computation specified by the software are performed by different computers. Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

Actions associated with implementing all or part of the functions can be performed by one or more programmable processors executing one or more computer programs to perform the functions described above, such as compensation of low frequency roll-off variations of microphones. All or part of the functions can be implemented as, special purpose logic circuitry, e.g., an FPGA and/or an ASIC (application-specific integrated circuit). In some implementations, at least a portion of the functions may also be executed on a floating point or fixed point digital signal processor (DSP) such as the Super Harvard Architecture Single-Chip Computer (SHARC) developed by Analog Devices Inc.

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Other examples and applications not specifically described herein are also within the scope of the following claims. Elements of different implementations described herein may be combined to form other examples not specifically set forth above. Elements may be left out of the structures described herein without adversely affecting their operation. Furthermore, various separate elements may be combined into one or more individual elements to perform the functions described herein.

A number of examples of the description have been described. Nevertheless, it will be understood that various modifications may be made without departing from the spirit and scope of the description. For example, some of the steps described above may be order independent, and thus can be performed in an order different from that described. It is to be understood that the foregoing description is intended to illustrate and not to limit the scope of the invention, which is defined by the scope of the appended claims.

For example, the microphone frequency response characteristics can be different from those shown in FIGS. 4A and 4B, so the compensation filters (e.g., 172 and 192) used to compensate variations in the low frequency roll-offs can have transfer functions different from those described above. The nominal low frequency roll-offs of the microphones can have values different from those described above. The compensation filters (e.g., 172 and 192) for compensating variations in the microphone characteristics can be used in active noise reduction devices different from those described above. The compensation filters (e.g., 172 and 192) for compensating variations in the microphone characteristics can be used in electronic devices different from those described above.

Other examples are within the scope of the following claims.

What is claimed is:

1. An active noise reduction (ANR) device comprising:

a first sensor configured to generate an input signal indicative of an environment of the active noise reduction device, in which the first sensor has a measured roll-off frequency;

a first compensator configured to process the input signal to generate a compensated input signal, in which the first compensator is configured to compensate a difference between the measured roll-off frequency and a predetermined roll-off frequency for the first sensor; and a second compensator to process the compensated input signal to generate a first signal for an acoustic transducer of the active noise reduction headphone.

2. The active noise reduction device of claim 1 in which the first sensor comprises a micro-electro-mechanical system (MEMS) microphone.

3. The active noise reduction device of claim 1 in which the first sensor is designed to have the predetermined roll-off frequency equal to f1 KHz, and the first sensor is manufactured using a process that, due to manufacturing tolerances, produces sensors that have measured roll-off frequencies that range from 0.8×f1 KHz to 1.2×f1 KHz, and the first compensator compensates for the difference between the measured roll-off frequency and f1 KHz.

4. The active noise reduction device of claim 1 in which the first compensator comprises a bi-quad filter.

5. The active noise reduction device of claim 4 in which the bi-quad filter comprises a digital bi-quad filter having at least one adjustable coefficient that is configured to be adjusted based on the measured roll-off frequency of the first sensor.

6. The active noise reduction device of claim 5 in which the at least one adjustable coefficient of the digital bi-quad filter is configured to be adjusted such that a combination of the first sensor and the first compensator has a frequency response that more closely resembles the frequency response of a sensor having the predetermined roll-off frequency, as compared to the frequency response of the first sensor.

7. The active noise reduction device of claim 5 in which the digital bi-quad filter has a transfer function represented by $$H(z) = \frac{b_0 + b_1 z^{-1} + b_2 z^{-2}}{1 + a_1 z^{-1} + a_2 z^{-2}},$$

$b_0$, $b_1$, $b_2$, $a_1$, and $a_2$ are filter coefficients, and the coefficient $b_1$ is configured to be adjusted based on the measured roll-off frequency of the first sensor.

8. The active noise reduction device of claim 7 in which the coefficient $b_1$ is configured to be adjusted based on the measured roll-off frequency of the microphone, the specified roll-off frequency for the microphone, and the coefficient $a_1$.

9. The active noise reduction device of claim 7 in which the coefficient $b_1$ is set according to a function of $a_1$ such that if the measured roll-off frequency of the microphone is equal to the specified roll-off frequency of the microphone, then $b_1=a_1$.

10. The active noise reduction device of claim 7 in which the coefficient $b_1$ is set according to:

$$b_1 = (a_1 + 1)\frac{f_{var}}{f_{nom}} - 1$$

$$b_1 = \left(\frac{f_{var}}{f_{nom}} a_1 + \frac{f_{var}}{f_{nom}}\right) - 1$$

wherein $f_{var}$ represents the measured roll-off frequency of the microphone, and $f_{nom}$ represents the specified roll-off frequency of the microphone.

11. The active noise reduction device of claim 7 in which values of the coefficients $b_0$, $b_2$, $a_1$, and $a_2$ are set before the roll-off frequency of the microphone is measured, and are not changed after the roll-off frequency of the microphone is measured.

12. The active noise reduction device of claim 7 in which $b_2$ is substantially equal to 0 and $a_2$ is substantially equal to 0.

13. The active noise reduction device of claim 1 in which the first sensor has a first frequency response, the first compensator has a second frequency response that approximates a ratio between a predetermined frequency response and the first frequency response, and the predetermined frequency response has the predetermined roll-off frequency.

14. The active noise reduction device of claim 1 in which the first sensor has a first frequency response that corresponds to a first transfer function, a second frequency response having the predetermined roll-off frequency corresponds to a second transfer function, and the first compensator has a third transfer function that is a ratio between the second transfer function and the first transfer function.

15. The active noise reduction device of claim 1 in which the second compensator is optimized to operate with a sensor having the predetermined roll-off frequency, and the first compensator modifies the input signal such that the compensated input signal mimics an input signal generated by a sensor having the predetermined roll-off frequency.

16. The active noise reduction device of claim 1 in which the first sensor comprises a feedforward microphone, and the second compensator comprises a feedforward compensator disposed in a feedforward signal flow path of the active noise reduction headphone.

17. The active noise reduction device of claim 16 in which the first signal represents an anti-noise signal configured to reduce an effect of ambient noise on an output of the acoustic transducer.

18. The active noise reduction device of claim 16, further comprising a feedback microphone and a feedback compensator disposed in a feedback signal flow path of the active noise reduction headphone, in which the feedback compensator is configured to generate a second signal for the acoustic transducer.

19. The active noise reduction device of claim 1 in which the first sensor comprises a feedback microphone, the second compensator comprises a feedback compensator disposed in a feedback signal flow path of the active noise reduction headphone, and the feedback compensator is configured to generate the first signal for the acoustic transducer.

20. An apparatus comprising:

a microphone configured to generate a pickup signal indicative of an environment of the apparatus, in which the microphone has a measured roll-off frequency that is different from a specified roll-off frequency for the microphone; and a compensator configured to process the pickup signal to generate a compensated pickup signal, in which the compensator is configured to compensate a difference between the measured roll-off frequency and the specified roll-off frequency for the microphone;

wherein the compensator comprises a bi-quad filter.

21. The apparatus of claim 20 in which the microphone comprises a micro-electro-mechanical system (MEMS) microphone.

22. The apparatus of claim 20 in which the microphone is designed to have the specified roll-off frequency equal to f1 KHz, and the microphone is manufactured using a process that, due to manufacturing tolerances, produces microphones that have measured roll-off frequencies that range from 0.8×f1 KHz to 1.2×f1 KHz, and the compensator compensates for the difference between the measured roll-off frequency and f1 KHz.

23. The apparatus of claim 20 in which the bi-quad filter comprises a digital bi-quad filter having at least one adjustable coefficient that is configured to be set based on the measured roll-off frequency of the microphone.

24. The apparatus of claim 20 in which the microphone has a first frequency response, the compensator has a second frequency response that approximates a ratio between a predetermined frequency response and the first frequency response, and the predetermined frequency response has the specified roll-off frequency.

25. The apparatus of claim 20 in which the apparatus comprises a circuit that is optimized to operate with a microphone having the specified roll-off frequency, and the compensator modifies the pickup signal such that the compensated pickup signal mimics a pickup signal generated by a microphone having the specified roll-off frequency.

26. The apparatus of claim 20 in which the bi-quad filter has a transfer function represented by $$H(z) = \frac{b_0 + b_1 z^{-1} + b_2 z^{-2}}{1 + a_1 z^{-1} + a_2 z^{-2}},$$

$b_0$, $b_1$, $b_2$, $a_1$, and $a_2$ are filter coefficients, and the coefficient $b_1$ is configured to be adjusted based on the measured roll-off frequency of the microphone, the specified roll-off frequency for the microphone, and the coefficient $a_1$.

27. A method comprising:

receiving an input signal representing audio captured by a microphone of an active noise reduction (ANR) headphone;

processing, by a first compensator, the input signal to generate a compensated input signal, in which processing the input signal comprises compensating a difference between a measured roll-off frequency and a specified roll-off frequency for the microphone; and processing, by a second compensator, the compensated input signal to generate a first signal for an acoustic transducer of the active noise reduction headphone.

28. The method of claim 27 in which the first compensator comprises a digital bi-quad filter having at least one adjustable coefficient that is set based on the measured roll-off frequency of the microphone.

29. The method of claim 28 in which the at least one adjustable coefficient is set to a value such that a combination of the microphone and the first compensator has a frequency response that more closely resembles the frequency response of a microphone having the specified roll-off frequency, as compared to the frequency response of the microphone.

30. The method of claim 27 in which the second compensator is optimized for the specified roll-off frequency, and processing the input signal comprises modifying the input signal such that the compensated input signal mimics an input signal generated by a microphone having the specified roll-off frequency.

31. The method of claim 27 in which generating the first signal comprises generating an anti-noise signal to reduce an effect of ambient noise on an output of the acoustic transducer.

32. The method of claim 27 in which receiving the input signal comprises receiving an input signal representing audio captured by a feedforward microphone of the active noise reduction headphone.

33. The method of claim 27 in which receiving the input signal comprises receiving an input signal representing audio captured by a feedback microphone of the active noise reduction headphone.

34. A method of calibrating an active noise reduction (ANR) headphone having a microphone, the method comprising:

measuring a roll-off frequency of the microphone to determine a measured roll-off frequency; and adjusting a configuration of a first compensator of the active noise reduction headphone, in which the first compensator is configured to compensate for a difference between the measured roll-off frequency and a predetermined roll-off frequency for the microphone, wherein the active noise reduction headphone comprises a second compensator that is configured to process an output of the first compensator to generate a first signal for an acoustic transducer of the active noise reduction headphone.

35. The method of claim 34 in which the first compensator comprises a digital bi-quad filter having at least one adjustable coefficient, and adjusting the configuration of the first compensator comprises adjusting the at least one adjustable coefficient of the digital bi-quad filter based on the measured roll-off frequency of the microphone.

* * * * *